US008827875B2

(12) United States Patent
Schiano

(10) Patent No.: US 8,827,875 B2
(45) Date of Patent: Sep. 9, 2014

(54) METHOD AND APPARATUS FOR EXERCISE DEVICE

(76) Inventor: Mark Schiano, Pearl River, NY (US)

( * ) Notice: Subject to any disclaimer, the term of this patent is extended or adjusted under 35 U.S.C. 154(b) by 230 days.

(21) Appl. No.: 13/446,178

(22) Filed: Apr. 13, 2012

(65) Prior Publication Data

US 2012/0329614 A1 Dec. 27, 2012

Related U.S. Application Data

(63) Continuation-in-part of application No. 13/168,369, filed on Jun. 24, 2011.

(51) Int. Cl.

| | |
|---|---|
| ***A63B 21/06*** | (2006.01) |
| ***A63B 21/00*** | (2006.01) |
| ***A63B 21/078*** | (2006.01) |

(52) U.S. Cl.

CPC ..... *A63B 21/078* (2013.01); *A63B 2225/093* (2013.01); *A63B 2021/0786* (2013.01)

USPC ..... 482/94; 482/93; 482/92

(58) Field of Classification Search

USPC ..... 482/104, 91–94

See application file for complete search history.

(56) References Cited

U.S. PATENT DOCUMENTS

| | | | | |
|---|---|---|---|---|
| 4,216,959 | A | 8/1980 | Niles | 272/123 |
| 4,253,662 | A * | 3/1981 | Podolak | 482/104 |
| 5,310,394 | A * | 5/1994 | Kallios | 482/104 |
| 5,989,166 | A * | 11/1999 | Capizzo et al. | 482/104 |
| 6,299,568 | B1 * | 10/2001 | Prok | 482/104 |
| 7,108,636 | B1 * | 9/2006 | Garcia | 482/40 |
| 7,338,416 | B2 * | 3/2008 | Smith | 482/104 |
| 7,374,515 | B2 * | 5/2008 | Slawinski et al. | 482/104 |
| 7,819,785 | B2 * | 10/2010 | Maiaro et al. | 482/104 |
| 2004/0259696 | A1 * | 12/2004 | Shifferaw | 482/94 |
| 2011/0230316 | A1 | 9/2011 | Johnson, III | 482/104 |

* cited by examiner

*Primary Examiner* — Loan H Thanh
*Assistant Examiner* — Megan Anderson
(74) *Attorney, Agent, or Firm* — Walter J. Tencza, Jr.

(57) ABSTRACT

An apparatus including first, second, third, and fourth vertical members, a first top horizontal member which joins a top of the first and a top of the second vertical members, a second top horizontal member which joins a top of the third and a top of the fourth vertical members, and a third top horizontal member which joins a top of the first top horizontal member and a top of the second top horizontal member. The first, second, third, and fourth vertical members, and the first, second, and third top horizontal members form a cage structure. The apparatus may also include first and second dumbbell holder members adjustably fixed to the cage structure. The apparatus may also include devices for suspending a first and a second dumbbell from the cage structure.

20 Claims, 21 Drawing Sheets

L1

R1

METHOD AND APPARATUS FOR EXERCISE DEVICE

CROSS REFERENCE TO RELATED APPLICATION(S)

The present application is a continuation in part of and hereby claims the priority of U.S. patent application Ser. No. 13/168,369, filed on Jun. 24, 2011. Patent application Ser. No. 13/168,369 is hereby incorporated by reference in its entirety.

FIELD OF THE INVENTION

This invention relates to improved methods and apparatus concerning exercise devices.

BACKGROUND OF THE INVENTION

There are various devices known in the prior art for exercise devices.

SUMMARY OF THE INVENTION

In at least one embodiment, an apparatus is provided comprising first, second, third, and fourth vertical members, a first top horizontal member which joins a top of the first and a top of the second vertical members, a second top horizontal member which joins a top of the third and a top of the fourth vertical members, and a third top horizontal member which joins a top of the first top horizontal member and a top of the second top horizontal member. The first, second, third, and fourth vertical members, and the first, second, and third top horizontal members form a cage structure.

The apparatus may also include a first dumbbell holder member adjustably fixed to the cage structure; and a second dumbbell holder member adjustably fixed to the cage structure. The first dumbbell holder member may include a curved portion onto which a central portion of a first dumbbell can be placed. The second dumbbell holder member may include a curved portion onto which a central portion of a second dumbbell can be placed. The apparatus may also include a device for adjusting a position of the first dumbbell holder member with respect to the cage structure, and a device for adjusting a position of the second dumbbell holder member with respect to the cage structure.

The apparatus may further include a first step structure fixed to the cage structure, so that a person can stand on the first step structure and adjust the position of the first dumbbell holder; and a second step structure fixed to the cage structure, so that a person can stand on the second step structure and adjust the position of the first dumbbell holder.

The apparatus may further include a device for suspending a first dumbbell from the cage structure; and a device for suspending a second dumbbell from the cage structure. The apparatus may further include a device for maintaining the first dumbbell in a stable state while the first dumbbell is suspended from the cage structure and while a person is taking one or more weights off of the first dumbbell, and a device for maintaining the second dumbbell in a stable state while the second dumbbell is suspended from the cage structure and while a person is taking one or more weights off of the second dumbbell. The apparatus may further include a device for suspending a barbell from the cage structure.

The device for suspending the first dumbbell from the cage structure may include a first sliding member which is connected to the cage structure so that the first sliding member can slide substantially parallel to the first, second, and third top horizontal members. The device for suspending the second dumbbell from the cage structure may include a second sliding member which is connected to the cage structure so that the second sliding member can slide substantially parallel to the first, second, and third top horizontal members.

The device for suspending the first dumbbell from the cage structure may include a first chain and a second chain. The device for suspending the first dumbbell from the cage structure may include a first elastic cord having first and second ends, the first end of the first elastic cord attached to the first chain at a first location, the second end of the first elastic cord attached to the first chain at a second location, differing from the first location. The device for suspending the first dumbbell from the cage structure may include a second elastic cord having first and second ends, the first end of the second elastic cord attached to the second chain at a third location, the second end of the second elastic cord attached to the second chain at a fourth location, differing from the third location.

The device for suspending the second dumbbell from the cage structure may include a third chain and a fourth chain. The device for suspending the second dumbbell from the cage structure may include a third elastic cord having first and second ends, the first end of the third elastic cord attached to the third chain at a fifth location, the second end of the third elastic cord attached to the third chain at a sixth location, differing from the fifth location. The device for suspending the second dumbbell from the cage structure may include a fourth elastic cord having first and second ends, the first end of the fourth elastic cord attached to the fourth chain at a seventh location, the second end of the fourth elastic cord attached to the fourth chain at an eighth location, differing from the seventh location.

The device for suspending the first dumbbell from the cage structure may include a fifth elastic cord having first and second ends, the first end of the fifth elastic cord attached to the first chain at a ninth location, the second end of the fifth elastic cord attached to the first chain at a tenth location, differing from the ninth location. The device for suspending the first dumbbell from the cage structure includes a sixth elastic cord having first and second ends, the first end of the sixth elastic cord attached to the second chain at an eleventh location, the second end of the sixth elastic cord attached to the second chain at a twelfth location, differing from the eleventh location.

The device for suspending the second dumbbell from the cage structure may include a seventh elastic cord having first and second ends, the first end of the seventh elastic cord attached to the third chain at a thirteenth location, the second end of the seventh elastic cord attached to the third chain at a fourteenth location, differing from the thirteenth location. The device for suspending the second dumbbell from the cage structure may include an eighth elastic cord having first and second ends, the first end of the eighth elastic cord attached to the fourth chain at a fifteenth location, the second end of the eighth elastic cord attached to the fourth chain at an sixteenth location, differing from the fifteenth location.

The device for maintaining the first dumbbell in a stable state while the first dumbbell is suspended from the cage structure and while a person is taking one or more weights off of the first dumbbell may include a first curved portion which is configured to wrap around a central portion of the first dumbbell. The device for maintaining the second dumbbell in a stable state while the second dumbbell is suspended from the cage structure and while a person is taking one or more weights off of the second dumbbell may include a second curved portion which is configured to wrap around a central portion of the second dumbbell.

The first curved portion may be fixed to a first plate having a first elongated slot. The second curved portion may be fixed to a second plate having a second elongated slot.

The device for maintaining the first dumbbell in a stable state while the first dumbbell is suspended from the cage structure and while a person is taking one or more weights off of the first dumbbell may include a third plate to which the first plate is adjustably connected through the first elongated slot so that the first plate can be adjusted in height with respect to the third plate, and wherein the third plate is fixed to the cage structure.

The device for maintaining the second dumbbell in a stable state while the second dumbbell is suspended from the cage structure and while a person is taking one or more weights off of the second dumbbell may include a fourth plate to which the second plate is adjustably connected through the second elongated slot so that the second plate can be adjusted in height with respect to the fourth plate, and wherein the fourth plate is fixed to the cage structure. The third plate may be fixed to the cage structure so that the third plate can slide substantially parallel to the first, second, and third top horizontal members to set the first curved portion at different horizontal locations.

The fourth plate may be fixed to the cage structure so that the fourth plate can slide substantially parallel to the first, second, and third top horizontal members to set the second curved portion at different horizontal locations.

The apparatus may further include a bench apparatus that can slide with respect to the cage structure. The bench apparatus may be connected to the cage structure so that the bench apparatus can be rotated with respect to the cage structure.

The bench apparatus may include a first member, a second member, and a weightlifting bench seat back portion which is attached to the first member; wherein the first member is rotatably mounted to the second member so that the first member and its attached weightlifting bench seat back portion can be placed in an inclined state, while the second member is substantially parallel to the first, second and third top horizontal members of the cage structure.

The bench apparatus may include a front support which supports a front portion of the bench apparatus, when a bottom of the front support is on a ground surface while an opposite rear portion of the bench apparatus is supported by the cage structure. The front support may be connected to the front portion of the bench apparatus, so that the front support can be put in a state where the front support rotates with respect to the front portion of the bench apparatus. The front support may include a telescoping member and a tube member, and wherein the telescoping member can slide in the tube member to raise or lower a height of the front support.

The apparatus may also include chin up bar member, wherein the cage structure and the bench apparatus are configured with respect to each other so that the chin up bar member can be placed in a first position, fixed to the cage structure, wherein the first position is above the head of an average human being so that the average human being can do chin ups; and wherein the cage structure and the bench apparatus are configured with respect to each other so that the chin up bar member can be placed in a second position, held off of the ground by the cage structure, in which a weightlifting bench seatback portion of the bench apparatus is held in an orientation which is at an angle with respect to the first, second, and third top horizontal members.

The apparatus may also include a fourth horizontal member fixed to the third horizontal member, such that the third horizontal member is at one vertical height and the fourth horizontal member is substantially parallel to the third horizontal member and at a different vertical height; wherein the fourth horizontal member is fixed to the cage structure through the third horizontal member but is not otherwise fixed to the cage structure.

The apparatus may also be comprised of a fifth horizontal member which is inserted into a first end of the fourth horizontal member and a sixth horizontal member which is inserted into a second end of the fourth horizontal member so that the fifth horizontal member and the sixth horizontal member telescope inside of the fourth horizontal member;

The fifth horizontal member may be configured to be attached to a device for suspending a first dumbbell from the cage structure, through the fifth horizontal member, wherein the device for suspending the first dumbbell is not attached to the cage structure other than through the fifth horizontal member, so that sliding the fifth horizontal member, while a portion of the fifth horizontal member is within the fourth horizontal member causes the device for suspending the first dumbbell to slide.

The sixth horizontal member may be configured to be attached to a device for suspending a second dumbbell from the cage structure, through the sixth horizontal member, wherein the device for suspending the second dumbbell is not attached to the cage structure other than through the sixth horizontal member, so that sliding the sixth horizontal member while a portion of the sixth horizontal member is within the fourth horizontal member, causes the device for suspending the first dumbbell to slide.

The device for suspending the first dumbbell from the cage structure may includes a pyramid shaped component which is fixed to the fifth horizontal member; and the device for suspending the second dumbbell from the cage structure may include a pyramid shaped component which is fixed to the sixth horizontal member. The pyramid shaped component may be made of solid steel.

DETAILED DESCRIPTION OF THE DRAWINGS

Figure 1A:
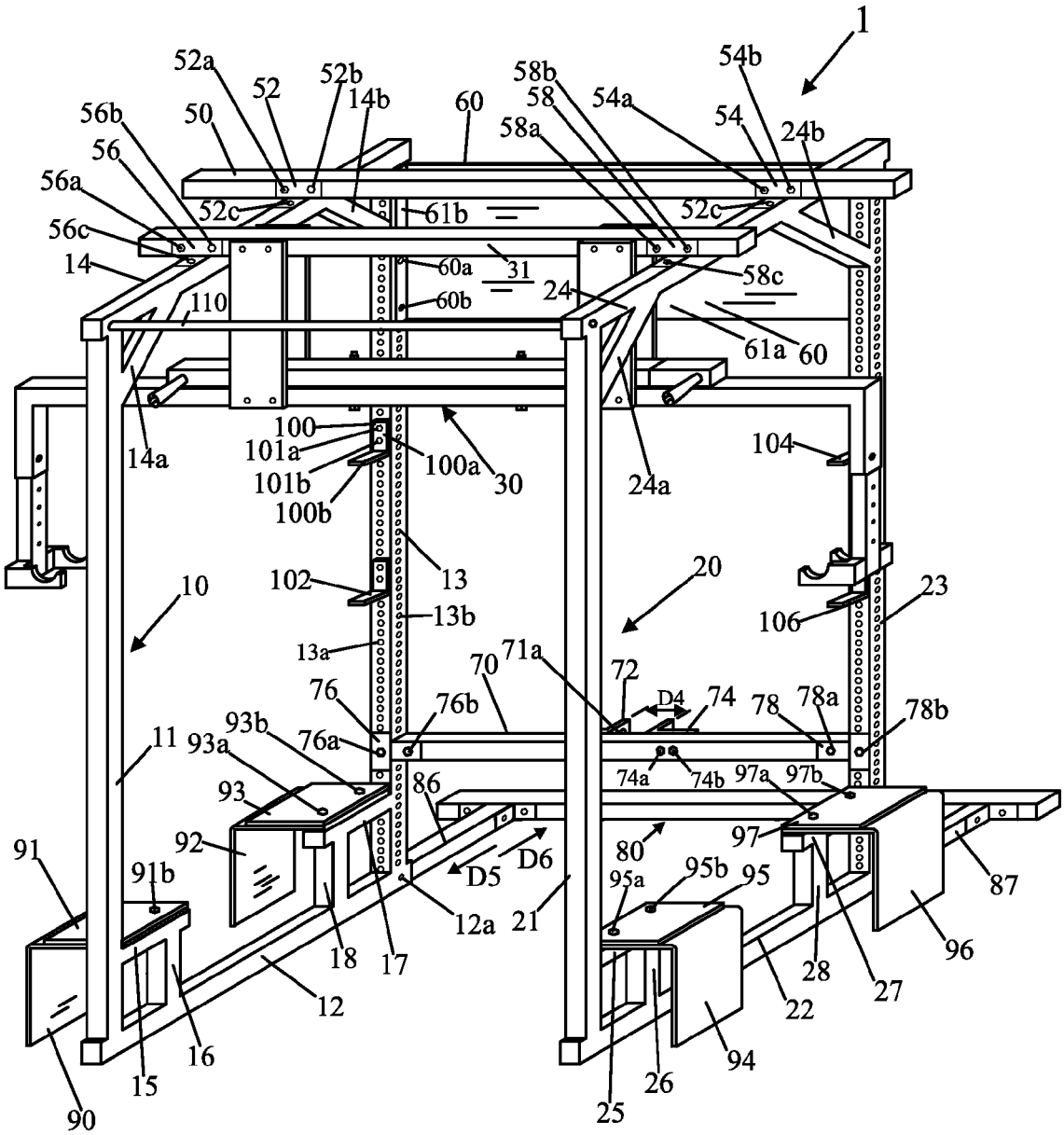
FIG. 1A shows a top, front, right perspective view of an apparatus in accordance with an embodiment of the present invention.
Figure 2:
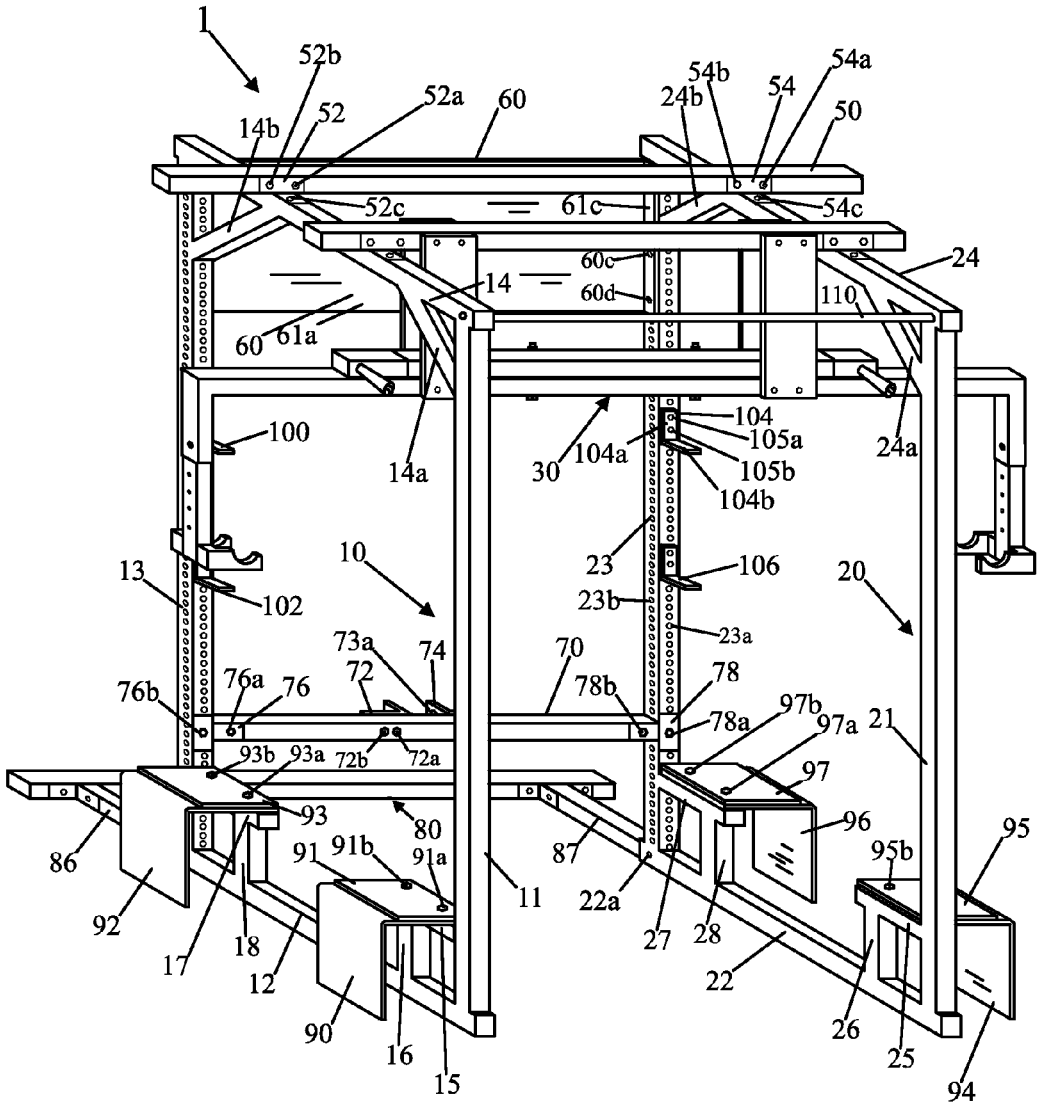
FIG. 2 shows a top, front, left perspective view of the apparatus of FIG. 1A.

FIG. 1A shows a top, front, right perspective view of an apparatus 1 in accordance with an embodiment of the present invention. FIG. 2 shows a top, front, left perspective view of the apparatus 1 of FIG. 1A.

Referring to FIGS. 1A and 2, the apparatus 1 includes a left support 10, a right support 20, a device 30, a beam 50, device 60, a beam 70, cage stabilizing portion 80, inverted L-shaped members 90, 92, 94, and 96, brackets 100, 102, 104, and 106, and a bar, rod, or member 110.

Bench apparatus members 300 and 302 shown in FIG. 11, to be described later, can be rotated in the direction C1 about pivot pin 304. The bar, rod, or member 110 shown in FIG. 1A may be a chin up bar which can be held on by clips or nuts at its opposite ends in the configuration of FIG. 1A and which can be removed or detached from the members 14 and 24 and inserted into a side opening of the member 13 and an side opening of the member 23 so that the member 110 is held up by the combination of the members 13 and 23 (one at each end), and so that the member 110 is substantially parallel to the member or beam 70 and to the ground. With the member 110 in place, held up by the combination of members 13 and 23, the bench apparatus members 300 and 302 can be rotated back in the direction opposite to C1, until the ends of the members 300 and 302 opposite the pivot pin 304, rest on member or chin up bar 110. This allows for an inclined bench setup, i.e. the members 300 and 302 of the bench apparatus are held in an inclined position.

Figure 3:
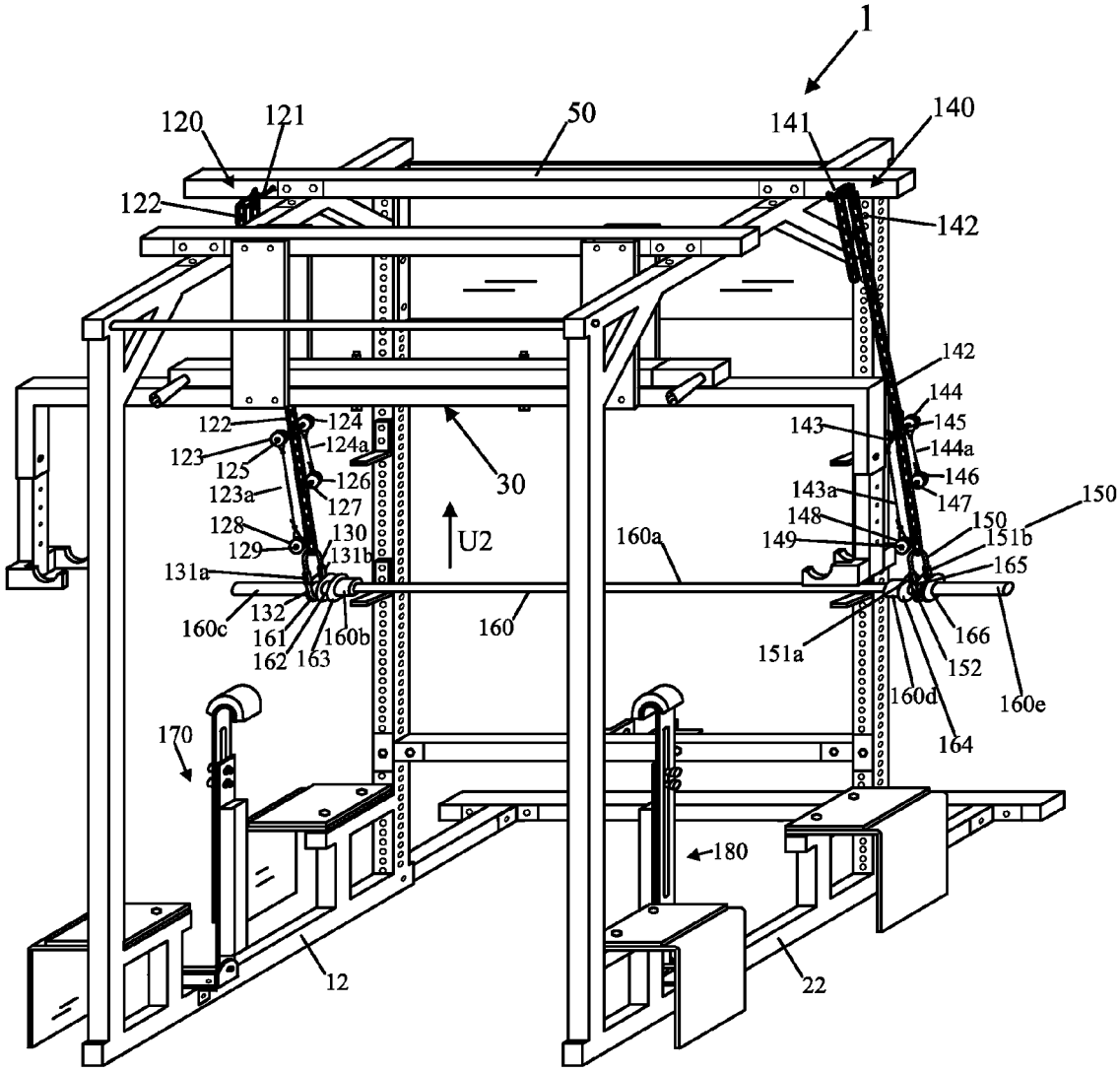
FIG. 3 shows a top, front, right perspective view of the apparatus of FIG. 1A along with a barbell, two devices for keeping the barbell from falling, and two devices for keeping dumbbells stable when hanging/suspended.

In at least one alternative embodiment the chin up bar or member 110 does not get attached with bolts or screws to members 13 and 23, rather bar or member 110 may be placed on so one of its ends rests on top of member 100*b* of the bracket 100 (or on an analogous member of bracket 102) and simultaneously the opposite end of the bar or member 110 rests and on top of member 104*b* of the bracket 104 (or analogous member of bracket 106), similar to the way the barbell 160 rests in FIG. 3, so that bar or member 110 is parallel to the member 70 (shown in FIG. 1A) and the ground. In at least one embodiment, the brackets 100, 102, 104, and 106 are bolted in place (brackets 100 and 102 on member 13 and brackets 104 and 106 on member 23) when the apparatus 1 is constructed. In at least one embodiment, at that time it will be determined how high they will want either the barbell 160 or the incline bar (the chinup bar or member 110) to sit, so that determines what level the brackets 100, 102, 104, and 106 will be attached, in at least one embodiment, i.e. typically the incline bar, chin up bar or member 110, determines what angle the members 300 and 302 (rotated in the C1 direction) (shown in FIG. 11), and the seat portion 308 (to which 300 and 302 are attached) will be placed at. Because the incline bar or chin up bar or member 110 just rests on two of the brackets, in at least one embodiment, such as 100 and 104, for example, the bar or member 110 can be put into place or taken away quickly. It makes it convenient between workout sets to change the member 110. There may be additional brackets, similar or identical to brackets 100, 102, 104, and 106 so that there are more levels to choose from for weight lifting exercises, such as many different incline heights to choose from.

The left support 10 includes members 11, 12, 13, 14, 14*a*, 14*b*, 15, 16, 17, and 18. Each of members 11, 12, 13, 14, 14*a*, 14*b*, 15, 16, 17, and 18 may be a hollow rectangular beam made substantially or entirely of a rigid strong metal, such as five gauge steel, in at least one embodiment. The members 11, 12, 13, 14, 14*a*, 14*b*, 15, 16, 17, and 18 may be integrated into one unit by welding, for example, so that for ease of assembly of apparatus 1, the left support 10 may be supplied as a single integrated unit. The member 13 has a plurality of front surface holes 13*a* and a plurality of side surface holes 13*b*. The member 23 has a plurality of front surface holes 23*a* and a plurality of side surface holes 23*b* (shown in FIG. 2).

The right support 20 includes members 21, 22, 23, 24, 24*a*, 24*b*, 25, 26, 27, and 28. Each of members 21, 22, 23, 24, 24*a*, 24*b*, 25, 26, 27, and 28 may be a hollow rectangular beam made substantially or entirely of a rigid strong metal, such as five gauge steel, in at least one embodiment. The members 21, 22, 23, 24, 24*a*, 24*b*, 25, 26, 27, and 28 may be integrated into one unit by welding, for example, so that for ease of assembly of apparatus 1, the right support 20 may be supplied as a single integrated unit.

Figure 1B:
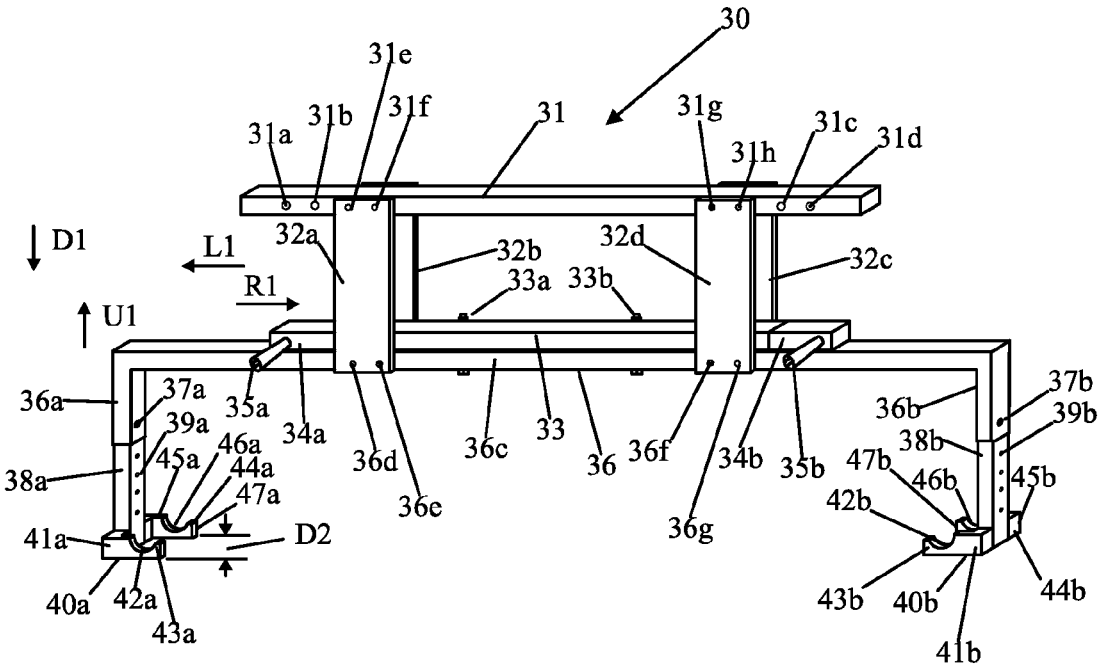
FIG. 1B shows a top, front, right perspective view of a portion of the apparatus of FIG. 1A.

FIG. 1B shows a top, front, right perspective view of the device 30, which is also shown in FIG. 1A. The device 30, for ease of assembly, may be provided as an integrated unit. The device 30 includes members 31, 33, 34*a*, 34*b*, 36, 38*a*, 38*b*, 40*a*, 44*a*, 40*b*, and 44*b*, handle devices 35*a*, 35*b*, and plates 32*a*, 32*b*, 32*c*, and 32*d*.

Members 31, 33, 34*a*, 34*b*, 38*a*, and 38*b* may be hollow rectangular or substantially rectangular tubes made substantially or entirely of a rigid strong metal, such as five gauge steel. Member 36 may be U-shaped and may also be hollow and made substantially or entirely of a rigid strong metal, such as five gauge steel. Plates 32*a-d* may be solid and made substantially or entirely of a rigid strong metal, such as five gauge steel. Members 40*a*, 44*a*, 40*b*, and 44*b* may be solid and made substantially or entirely of a rigid strong metal, such as five gauge steel or such as one to one and one half inch steel.

Figure 17A:
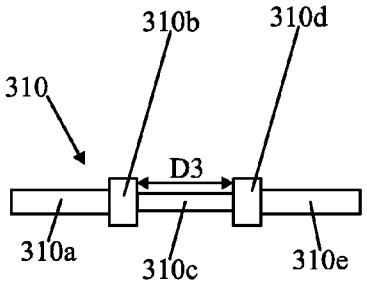
FIG. 17A shows a side view of the first dumbbell.
Figure 17B:
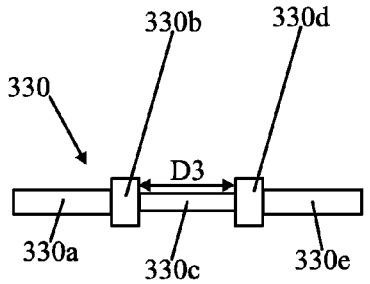
FIG. 17B shows a side view of the second dumbbell.

The members 40*a* and 44*a* are fixed, such as by welding, or integrated with the member 38*a*, such that the members 40*a* and 44*a* are parallel to each other and are spaced apart so that their outer parallel surfaces, as shown in FIG. 1B, are a distance D2 away from each other which is slightly less than the spacing D3 between the portions 310*b* and 310*d* shown in FIG. 17A of an olympic (trademarked) dumbbell 310 (or the identical distance D3 between the identical portions 330*b* and 330*d* of the identical dumbbell 330 shown in FIG. 17B). This allows the dumbbell 310 to be placed on and to rest on curved or arced portions 42*a* and 46*a* of the members 40*a* and 46*a* respectively, such that portion 310*c* (or portion 330*c*) of the dumbbell 310 rests on the tops of curved or arced portions 42*a* and 46*a*. The member 40*a* includes straight portion 41*a* fixed at a bottom end of member 38*a*, curved or arced portion 42*a* and straight end portion 43*a* which keeps the dumbbell 310 from falling out of the curved or arced portion 42*a*.

The members 40*b* and 44*b* are fixed, such as by welding, or integrated with the member 38*b*, such that the members 40*b* and 44*b* are parallel to each other and are spaced apart so that their outer parallel surfaces, as shown in FIG. 1B, are a distance D2 away from each other which is slightly less than the spacing D3 between the portions 330*b* and 330*d* shown in FIG. 17B of an olympic (trademarked) dumbbell 330. This allows the dumbbell 330 to be placed on and to rest on curved or arced portions 42*b* and 46*b* of the members 40*b* and 46*b* respectively, such that portion 330*c* of the dumbbell 330 rests on the tops of curved or arced portions 42*b* and 46*b*. The member 40*b* includes straight portion 41*b* fixed at a bottom end of member 38*b*, curved or arced portion 42*b* and straight end portion 43*b* which keeps the dumbbell 330 from falling out of the curved or arced portion 43*b*.

Figure 15:
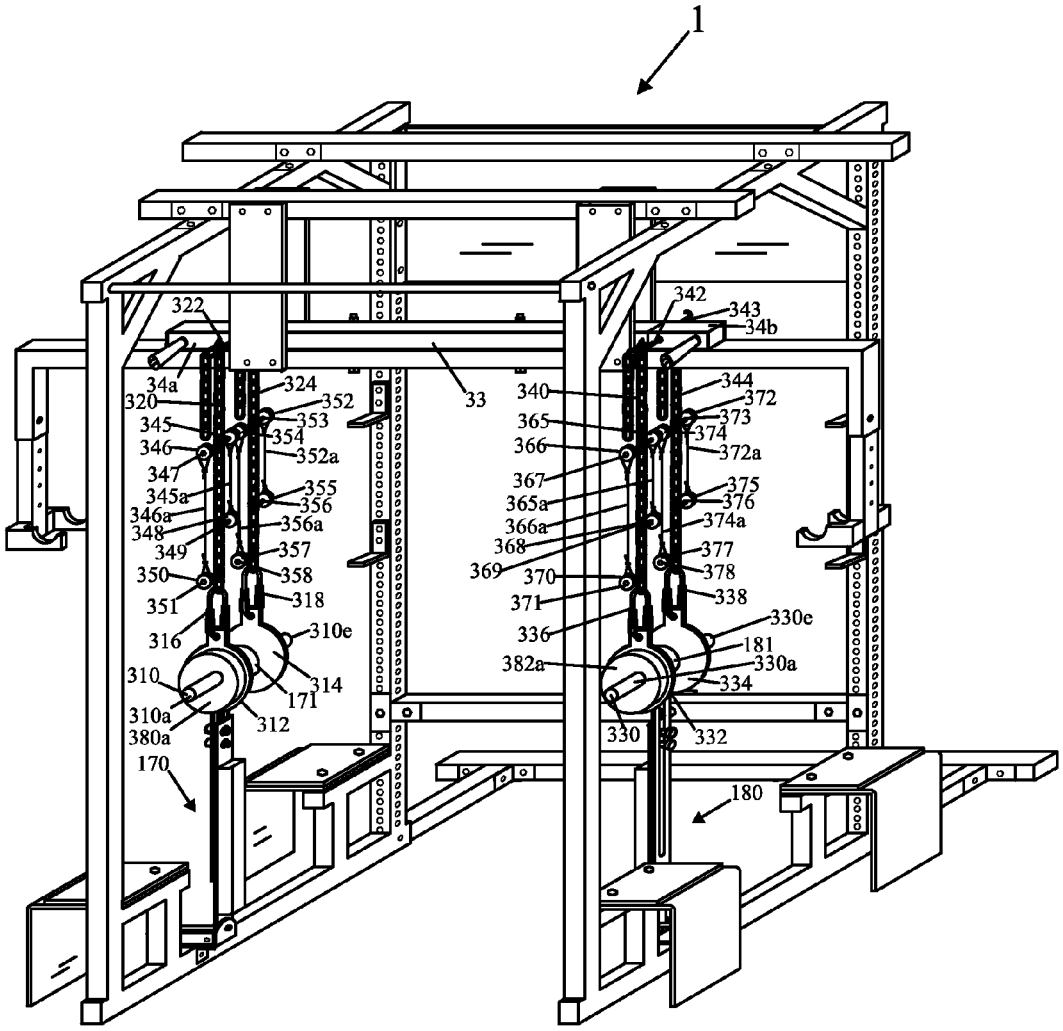
FIG. 15 shows a top, front, right perspective view of the components shown in FIG. 14 and additionally shows devices attached to chains for keeping the chains out of a weightlifter's way, and also shows a weight on each of the dumbbells.
Figure 19:
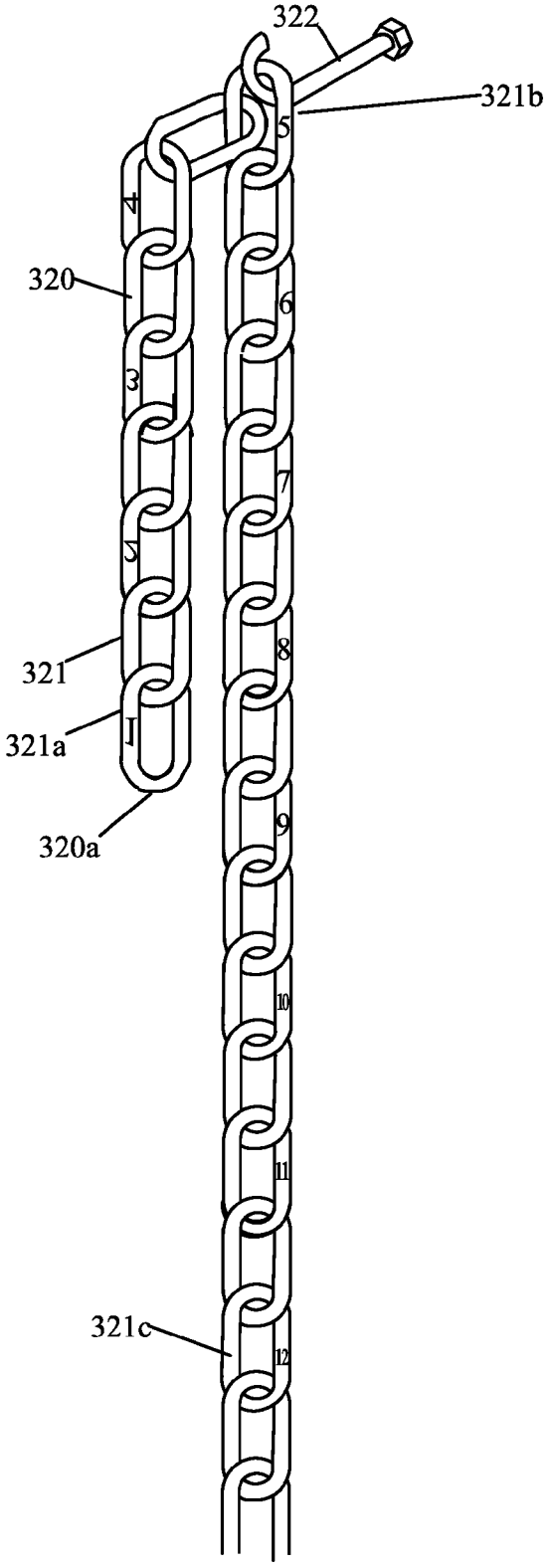
FIG. 19 shows a close up front, top, right perspective view of a chain, on a hook, for keeping a barbell or a dumbbell from falling.

In at least one embodiment the dumbbell 310 can be placed on the member 40*a*, with the chains 322 and 324 attached to the dumbbell 310 by oval structures 316 and 318, such that portion 310*c* rests on tops of curved or arced portions 42*a* and 46*a*, and then the chains 320 and 324, shown in FIG. 15 can be adjusted to whatever vertical level is desired by placing a chain link on the hooks 322 (for chain 320) and another hook (not shown, for chain 324). A number indication or designation for the vertical level of chain 320 may be as shown in FIG. 19, such as indication "5" for a certain vertical level of chain 320. After the chains 320 and 324 have been fixed to hooks (322 and hook not shown) and thereby fixed to member 33 then, in at least one embodiment the dumbbell 310 can be taken off of the member 40*a*, and can now be suspended as shown in FIG. 15 from the member 33.

Similarly, the dumbbell 330 can be placed on the member 40*b*, such that portion 330*c* rests on tops of curved or arced portions 42*b* and 46*b*, and then the chains 340 and 344, shown in FIG. 15 can be adjusted to whatever vertical level is desired by placing a chain link on the hooks 342 (for chain 340) and hook 343 (for chain 344). A number indication or designation for the vertical level of chain 340, which may be identical to the chain 320, as shown in FIG. 19, such as indication "5" for a certain vertical level of chain 340. After the chains 340 and 344 have been fixed to hooks (342 and 343) and thereby fixed to member 33) then, in at least one embodiment the dumbbell 330 can be taken off of the member 40*b*, and can now be suspended as shown in FIG. 15 from the member 33.

The members 38*a* and 38*b* may slide or telescope upwards in the direction U1 or downwards in the direction D1 shown in FIG. 1B, within portions 36*a* and 36*b* of the U-shaped member 36, when pins or bolts 37*a* and 37*b* are not inserted into openings of portions 36*a* and 36*b*. The pins or bolts, 37*a* and 37*b* may be provided with nuts or some other attachment device to fix the members 38*a* and 38*b* inside of a cavity of the portions 36*a* and 36*b*, respectively. The members 38*a* and 38*b* have a plurality of openings 39*a* and 39*b*, to set the members 38*a* and 38*b*, using pins 37*a* and 37*b* at different vertical positions within portions 36*a* and 36*b* respectively.

The member 33 may be fixed onto the member 36 by nut and bolt combinations 33*a* and 33*b*. The member 31 may be fixed to the member 36 by plates 32*a-d* and nut and bolt combinations 31*e*, 31*f*, 31*g*, 31*h*, 36*d*, 36*e*, 36*f*, and 36*g*.

The handles or handle devices 35*a* and 35*b* may be fixed to the members 34*a* and 34*b*, respectively by nuts and bolts, so that the handles or handle devices 35*a* and 35*b* protrude outward substantially perpendicularly or perpendicularly to the members 34*a* and 34*b*, respectively. The members 34*a* and 34*b* may slide or telescope in the directions R1 or L1 within hollow cavities of the member 33 except when the members 34*a* and 34*b* are fixed, such as by nuts and bolts, not shown, to the member 33.

The member 31 has openings 31*a* and 31*b* shown in FIG. 1B for fixing the device 30 to the member 14 of the left support 10, via bracket 56, and nut and bolt combinations 56*a*, 56*b*, and 56*c*, shown in FIG. 1A. The member has openings 31*c* and 31*d* shown in FIG. 1B for fixing the device 30 to the member 24 of the right support 20, via bracket 58, and nut and bolt combinations 58*a*, 58*b*, and 58*c*, shown in FIG. 1A.

Figure 1C:
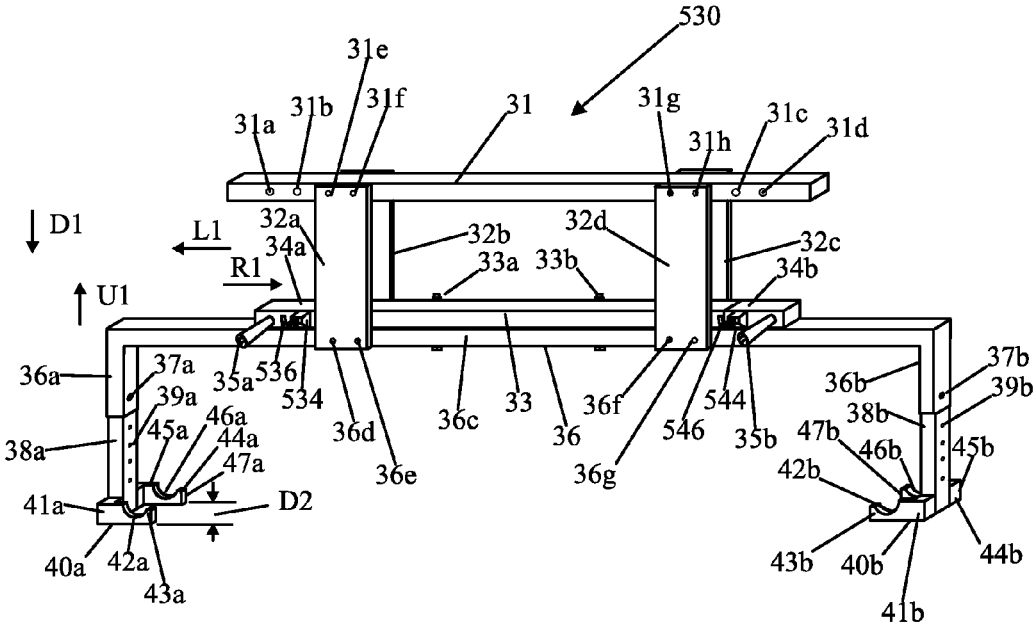
FIG. 1C shows a top, front, right perspective view of a modified embodiment for the portion of FIG. 1B.

FIG. 1C shows a top, front, right perspective view of a modified embodiment or apparatus 530 for the portion of FIG. 1B. The apparatus or device 530 may be the same as the apparatus or device 30 shown in FIG. 1B, except as will be described. The apparatus or device 530 includes pyramid spacers 534 and 544 which may be fixed to members 34*a* and 34*b*, respectively, via anchor bolts 536 and 546.

Figure 1D:
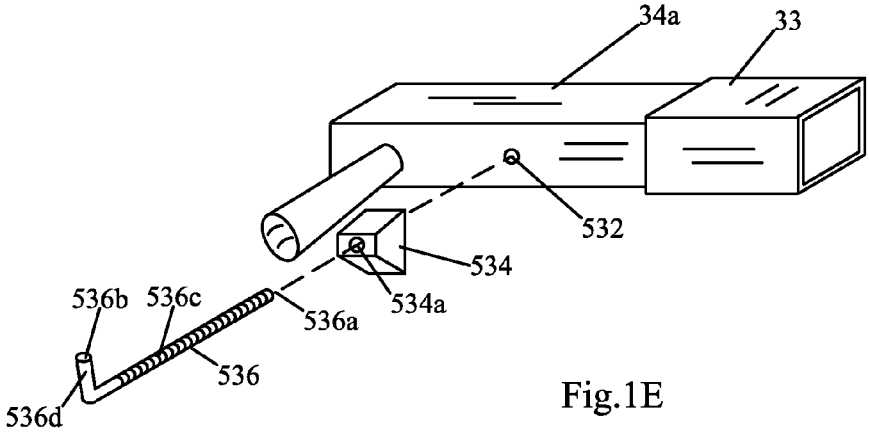
FIG. 1D shows a top, front, right perspective close up view of part of the modified embodiment for the portion of FIG. 1C, with various components shown taken apart.

FIG. 1D shows a top, front, right perspective close up view of part of the modified embodiment for the portion of FIG. 1C, with various components shown taken apart. In FIG. 1D the anchor bolt 536 is shown taken apart from the pyramid spacer 534 and the member 34*a*. Only a portion of the member 34*a* and the member 33 (in which the member 34*a* telescopes or in which a portion of member 34*a* slides) are shown in FIG. 1D. The anchor bolt 536 has ends 536*b* and 536*a*, a threaded portion 536*c*, and a portion 536*d*, substantially perpendicular to the threaded portion 536*b*. The pyramid spacer 534 has an opening 534*a* which passes through the spacer 534. The bolt 536 has an L-shape so that a chain, such as chain 320 shown in FIG. 15 can be placed by inserting end 536*b* through a chain link or looping a chain link of chain 320 over end 536*b*, when the bolt 536 is fixed in the state of FIG. 1E, fixed to the member 34*a*, so that chain 320 does not fall off of the bolt 536, and is held suspended from the member 34*a*, i.e. similar or the same as shown in FIG. 19.

Figure 1E:
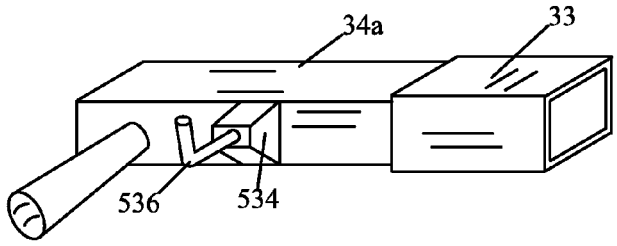
FIG. 1E shows a top, front, right perspective close up view of part of the modified embodiment for the portion of FIG. 1C, with various components shown put together.

FIG. 1E shows a top, front, right perspective close up view of part of the modified embodiment for the portion of FIG. 1C, with various components shown put together. In FIG. 1E, the end 536*a* of the bolt 536 has been inserted and/or screwed into and through the opening 534*a* and into and through the opening 532 in the member 34*a*. A nut may be attached on the other side of the member 34*a* to fix the bolt 536 to the member 34*a*. The pyramid spacer 534 may be made of steel such as solid steel and is beneficial because of its strength when used in conjunction with bolt 536. The spacer 544 and the bolt 546 may be identical to the spacer 534 and the bolt 546 and may be attached or fixed in an analogous way the member 34*b*, which has a portion which slides in the member 33.

The beam 50, shown in FIG. 1A, has openings, not shown, for fixing the beam 50 to the member 14 of the left support 10, via bracket 52, and nut and bolt combinations 52*a*, 52*b*, and 52*c*, shown in FIG. 1A. The member has openings, not shown, for fixing the beam 50 to the member 24 of the right support 20, via bracket 54, and nut and bolt combinations 54*a*, 54*b*, and 54*c*, shown in FIG. 1A. The beam 50 may be made substantially or entirely of a rigid strong metal, such as five gauge steel The device 60 may connect the beam 13 to the beam 23 to provide additional support for the apparatus 1. The device 60 may include plate 61*a*, and flanges or members 61*b* shown in FIG. 1A and 61*c* shown in FIG. 2. The members or flanges 61*b* and 61*c* may be at a right angle with respect to the plate 61*a*, and may attach or fix the device 60 to the member 13 (through nut and bolt combinations 60*a* and 60*b* shown in FIG. 1A) and to the member 23 (through nut and bolt combinations 60*c* and 60*d* shown in FIG. 2), respectively. There may be additional nut and bolt combinations, not shown which connect flanges or members 61*b* and 61*c* to the members 13 and 23, respectively. The device 60 may be made substantially or entirely of a rigid strong metal, such as five gauge steel The beam 70 may be fixed at one end to the member 13 via T-shaped bracket 76 through nut and bolt combinations 76*a* and 76*b*, and fixed at an opposite end to the member 23 via T-shaped bracket 78 through nut and bolt combinations 78*a* and 78*b*. The beam 70 is typically fixed so that it is parallel to the members 50 and 31 and perpendicular to the members 13 and 23. The member 70 has fixed thereto L-shaped bracket 72 through nut and bolt combinations 72*a* and 72*b* shown in FIG. 2, and 74, through nut and bolt combinations 74*a* and 74*b*, shown in FIG. 1A. The L-shaped brackets 72 and 74 are fixed substantially parallel to one another, so that an opening 71*a* (shown in FIG. 1A) in the bracket 72 is aligned with the opening 73*a* (shown in FIG. 2) in the bracket 74 for insertion of a pin for pivoting a bench for into various positions as will be described. Parallel inside surfaces of the brackets 72 and 74 are separated by a distance of D4 which is slightly greater than a rectangular tube member 264 shown in FIG. 10 which can be inserted between brackets 72 and 74 and which pivots about a pivot pin inserted through openings 71, 73*a* and through the rectangular tube member 264, to allow a bench apparatus to be rotated to different positions or states. Member 70 may be made substantially or entirely of a rigid strong metal, such as five gauge steel.

Figure 8:
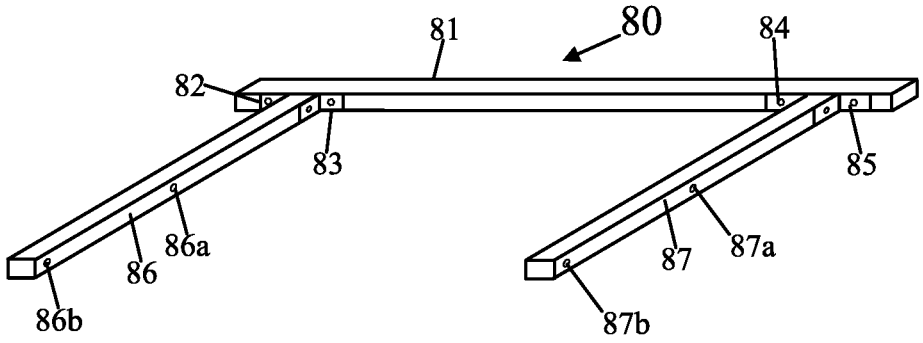
FIG. 8 shows a top, front, right perspective view of a cage stabilizing portion of the apparatus of FIG. 1A.

FIG. 8 shows a top, front, right perspective view of the cage stabilizing portion 80 of the apparatus 1. The cage stabilizing portion 80 includes a member 81, a member 86, and a member 87. The member 86 is fixed, substantially at a right angle or at a right angle, to the member 81 by L-brackets 82 and 83 and nuts and bolt combinations. The member 87 is fixed, substantially at a right angle or at a right angle by L-brackets 84 and 85 and nut and bolt combinations. The member 86 has openings 86*a* and 86*b*. The member 87 has openings 87*a* and 87*b*. The members 86 and 87 can be slid into the hollow cavities of the members 12 and 22, respectively, in the directions D5 or D6 shown in FIG. 1A, when not fixed. The members 86 and 87 can be fixed with respect to the members 12 and 22, by pin and/or nut and bolt 12*a* (FIG. 1A) and pin and/or nut and bolt 22*a* (FIG. 2), respectively. Members 81, 86, and 87 may be made substantially or entirely of a rigid strong metal, such as five gauge steel.

Plates 91, 93, 95, and 97 may be fixed to the top of inverted L-shaped members 90, 92, 94, and 96, by nut and bolt combinations. The inverted L-shaped members 90, 92, 94, and 96 may be used a stepping platform. Plate 91 may be fixed by nut and bolt combinations 91*a* and 91*b* (see FIG. 2) to inverted L-shaped member 92 and to member 17. Referring to FIG. 1A, plate 93 may be fixed by nut and bolt combinations 93*a* and 93*b* to inverted L-shaped member 92 and to member 17. Plate 95 may be fixed by nut and bolt combinations 95*a* and 95*b* to inverted L-shape member 94 and to member 25. Plate 97 may be fixed by nut and bolt combinations 97*a* and 97*b* to inverted L-shape member 96 and to member 27. Each of plates 91, 93, 95, and 97, and inverted L-shaped members 90, 92, 94, and 96 may be made of a rigid strong metal, such as steel, such as five gauge steel.

Brackets 100, 102, 104, and 106 are shown in FIG. 1A. Each of brackets 100, 102, 104, and 106 may be made substantially or entirely of a rigid strong metal, such as five gauge steel. Each of brackets 100, 102, 104, and 106 is identical, therefore only bracket 100 will be described. Bracket 100 includes a top plate 100*a* and a bottom plate 100*b*. The bottom plate 100*b* is at a less than ninety degree angle (i.e. tilted upwards from perpendicular) with respect to the top plate 100*a*, so that a barbell, such as barbell 160 in FIG. 3, can be placed on the bottom plate 100*b* and will not fall off the bottom plate 100*b*. The bracket 100 is temporarily fixed to the member 13 by bolt and nut combinations 101*a* and 101*b*, wherein the bolt of the bolt and nut combinations 101*a* and 101*b*, passes through holes in the member 13. Similarly, the bracket 102 is fixed to the member 13 and the brackets 104 and 106 are fixed to the member 23.

FIG. 3 shows a top, front, right perspective view of the apparatus 1 along with the barbell 160, two devices, 120 and 140, for keeping the barbell 160 from falling, and two devices, 170 and 1800 for keeping dumbbells, to be described later stable while changing weights on the dumbbells.

The device 120 includes a hook device 121 which is fixed to the member 50. The device 120 further includes a chain 122, which may be made of metal, such as five gauge steel. The chain 122 hangs from the hook 121. The device 120 further includes spools 123, 124, 126, and 128, and attachment devices 125, 127, and 129. The device 120 further includes elastic cords 123*a* and 124*a*, U-shaped bolt 130, nuts or connectors 131*a* and 131*b*, and U-shaped bolt 132. The U-shaped bolt 130 is connected by the connectors, also called coupling nuts 131*a* and 131*b*, to the U-shaped bolt 132 to form a metal oval structure.

Figure 20:
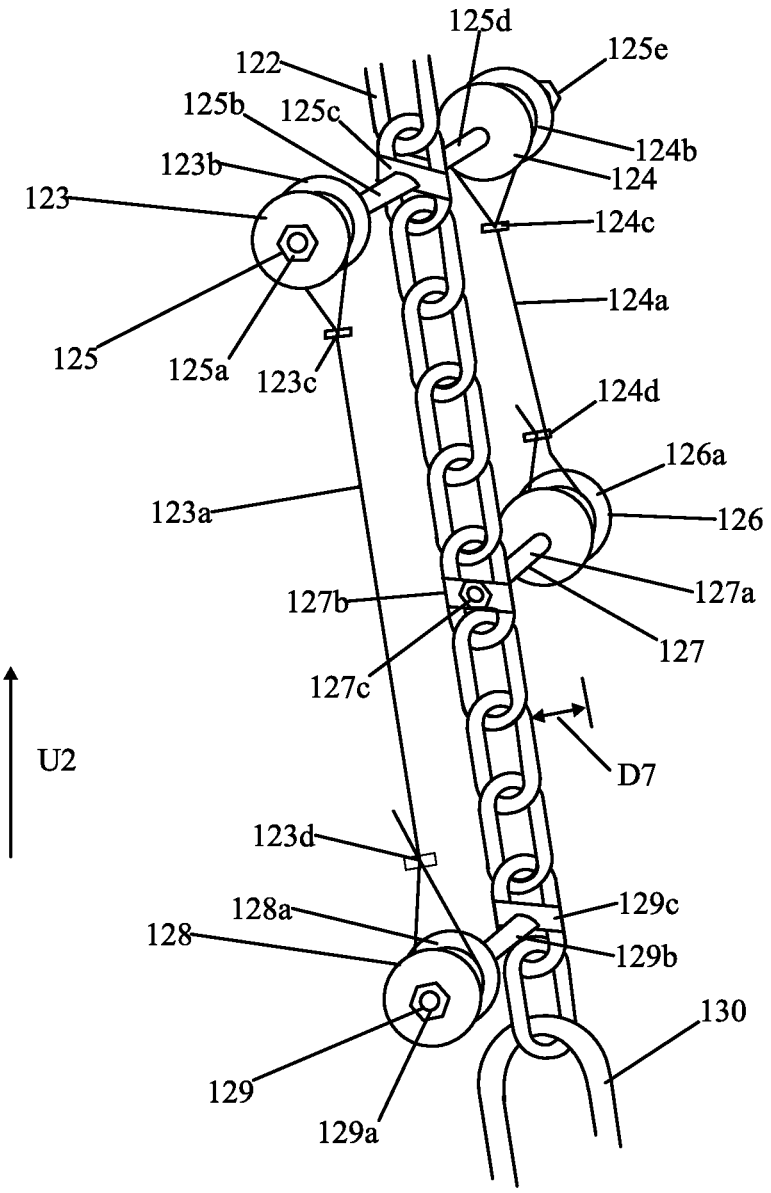
FIG. 20 shows a close up front, top, right perspective view of a chain, and a further device for keeping the chain out of a weightlifter's way.

A close up view of a portion of the device 120 is shown in FIG. 20. In FIG. 20, the spools 123 and 124 are fixed to a chain link of the chain 122 by the attachment device 125. The attachment device 125 includes, a nut 125*a*, a threaded rod and/or spacer combination 125*b*, a plate 125*c*, a threaded rod and/or spacer combination 125*d*, and a nut 125*e*. The attachment device 125 may include further spacers and/or nuts and/bolts, and/or threaded rods not shown. The attachment device 125 is configured to keep the spool 123 and the spool 124 at a fixed distance, D7, shown in FIG. 20, from the chain 122, wherein D7 may be in the range of two to four inches, and in at least one embodiment, these dimensions are critical for keeping the elastic cords 123*a* and 124*a* from interfering in normal weightlifting operations and from functioning properly.

The spool 126 is fixed to a chain link of the chain 122 by the attachment device 127. The attachment device 125 includes, a nut 127*c*, a threaded rod and/or spacer combination 127*a*, and a plate 127*b*. The attachment device 127 may include further spacers and/or nuts and/bolts not shown. The attachment device 127 is configured to keep the spool 126 at a fixed distance, D7, shown in FIG. 20, from the chain 122, wherein D7 may be in the range of two to four inches, and in at least one embodiment, these dimensions are critical for keeping the elastic cord 124*a* from interfering in normal weightlifting operations and from functioning properly.

The spool 128 is fixed to a chain link of the chain 122 by the attachment device 129. The attachment device 129 includes, a nut 129*a*, a threaded rod and/or spacer combination 129*b*, and a plate 129*c*. The attachment device 129 may include further spacers and/or nuts and/bolts and/or threaded rods not shown. The attachment device 129 is configured to keep the spool 128 at a fixed distance such as D7, from the chain 122, wherein D7 may be in the range of two to four inches, and in at least one embodiment, these dimensions are critical for keeping the elastic cord 123*a* from interfering in normal weightlifting operations and from functioning properly.

The elastic cord 123*a* is wound at one end around a channel 123*b* of the spool 123 and at an opposite end around a channel 128*a* of the spool 128, so that the elastic cord 123*a* is stretched tightly when in the position of FIG. 20. Clips 123*c* and 123*d*, attach an end of the elastic cord 123*a* to another portion of the elastic cord 123*a* to form and hold loops in the elastic cord 123*a*, to fix the elastic cord to the spools 123 and 128. The elastic cord 124*a* is wound at one end around a channel 124*b* of the spool 124 and at an opposite end around a channel 126*a* of the spool 126, so that the elastic cord 124*a* is stretched tightly when in the position of FIG. 20. Clips 124*c* and 124*d*, attach an end of the elastic cord 124*a* to another portion of the elastic cord 124*a* to form and hold loops in the elastic cord 124*a*, to fix the elastic cord to the spools 124 and 126.

The device 120 keeps the chain 122 from bunching up or tangling around the barbell 160, or snagging up on the barbell 160 (and/or the dumbbell 310 or 330, when the analogous or identical device is used on the dumbbell 310 or 330 shown in FIG. 15) when the U-shaped member 130, or the barbell 160 is lifted upwards in the direction U2 shown in FIG. 3. The use of device 120 also prevents or inhibits the chain 122 from going below the barbell 160 as the barbell 160 is lifted up in the direction U2, and this prevents or inhibits the chain 122 from adding to the weight of the barbell 160. I.e. when the barbell 160 is lifted upwards in the direction U2, if part of the chain 122 ended up vertically below the barbell 160, then a weightlifter would be lifting both the barbell 160 and part of the chain 122. The devices 140, 200, and 220 provide the same functions for their respective chains 142 (FIG. 3), 202 (FIGS. 4 and 5), and 222 (FIGS. 4 and 5), i.e. to keep their respective chains from tangling, bunching up or adding to the weight of the barbell 160. There are also analogous devices in FIG. 15 providing for the same function to keep the chains 320, 324, 340, and 344 from tangling, bunching up, or adding to the weight of the appropriate dumbbell (dumbbell 310 for chains 320 and 324, and dumbbell 330 for chains 340 and 344).

The inventor has determined that having two elastic cords 123*a* and 124*a* which are attached in the manner shown at one point from the same vertical height (i.e. spools 123 and 124 are at the same vertical height), but connected to points at two different vertical heights (i.e. spools 126 and 128 are connected at two different vertical heights) helps greatly to keep the chain 122 from tangling or bunching up and/or reduces the slack when someone lifts the barbell 160 (and thereby the U-shaped member 130) in the direction U2.

The spools 123, 124, 126, and 128 are fixed to the chain 122 by the devices 125 (for spools 123 and 124), 127 (for spool 126), and 129 (for spool 128) so that the spools 123, 124, 126, and 128 do not substantially change orientation or distance with respect to the particular chain link that they are attached to. The inventor has determined that this also helps to reduce slack, bunching up, or interference of the chain 122 while a person is lifting barbell 160 (and U-shaped bolt 130 in the direction U2 shown.

Figure 7A:
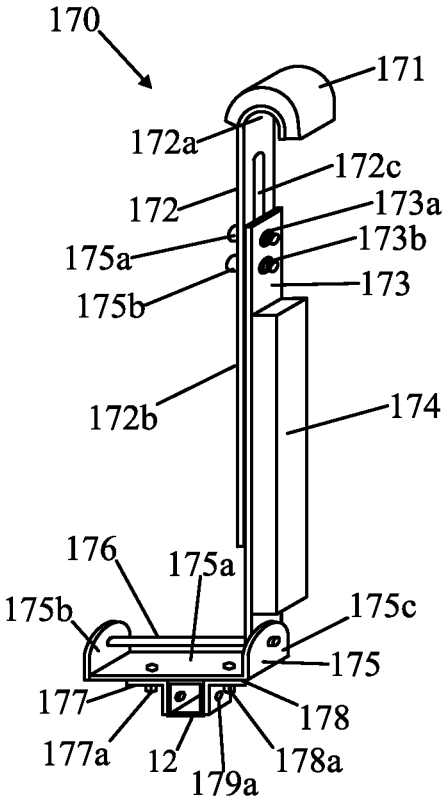
FIG. 7A shows a top, front, right perspective view of a first device, of the two devices for keeping dumbbells stable.
Figure 7B:
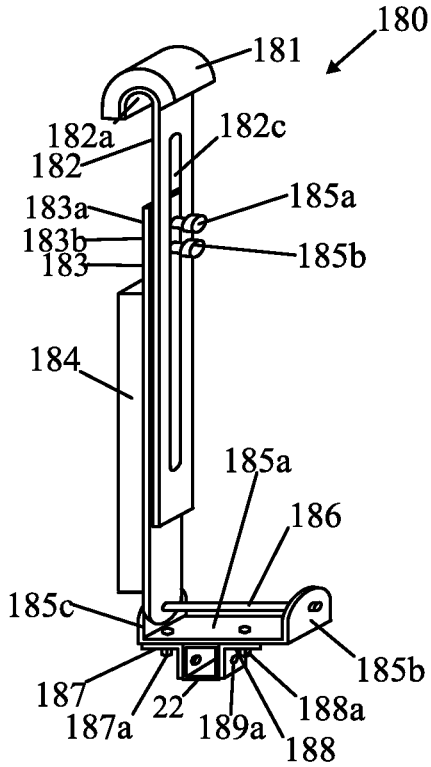
FIG. 7B shows a top, front, right perspective view of a second device, of the two devices for keeping dumbbells stable.

FIG. 3 also shows the devices 170 and 180 for stabilizing dumbbells. The devices 170 and 180 may be identical, and as placed in FIG. 3, are mirror images of each other. FIGS. 7A shows a top, front, right perspective view of the device 170 as it is placed in FIG. 3, showing a portion of the member 12. The view of FIG. 7A is the same as (with the exception of member 12 being replaced by member 22) of a top, rear, left, perspective view of the device 180 as it is placed in FIG. 3. FIG. 7B shows a top, front, right perspective view of a the device 180 as it is placed in FIG. 3, showing a portion of member 22. The view of FIG. 7B is the same as (with the exception of member 22 being replaced by member 12) of a top, rear, left, perspective view of the device 180 as it is placed in FIG. 3.

The device 170 includes cushion material 171, which may be rubber or foam, device 172 which may include curved or arced portion 172*a* and straight portion 172*b* The device 172 may also have a slot 172*c* running down a substantial length of the straight portion 172*b*. The device 170 also includes a plate 173 having openings 173*a* and 173*b* into which are inserted pins, screws or bolts, or nut and bolt combinations 175*a* and 175*b*, which fix the device 172 with respect to the plate 173. I.e. the pins or bolts of combinations 175*a* and 175*b* are inserted through slot 172*c* and then through openings 173*a* and 173*b*, respectively and tightened to hold the device 172 at a particular vertical position with respect to the plate 173. The plate 173 is fixed to a device 175 so that the plate 173 does not rotate with respect to the device 175. A cushion material 174 may be attached by velcro (trademarked) to the plate 173.

The device 175 may include a central portion 175*a* and flanges or protrusions 175*b* and 175*c* which may be at right angles with respect to the central portion 175*a*. A pin or rod 176 whose function enables 170 and 178 to slide across its length may connect the plate 173 to the protrusion 175*c*. The portion 175*a* is fixed to L brackets 177 and 178, via nut and bolt combinations 177*a* and 178*a* and via nut and bolt combination 179*a* the portion 175*a* is fixed to the member 12, thereby fixing the device 170 to the member 12.

The device 180 may be identical to the device 170. The device 180 includes cushion material 181, which may be rubber or foam. The device 182 which may include curved or arced portion 182*a* and straight portion 182*b* The device 182 may also have a slot 182*c* running down a substantial length of the straight portion 182*b*. The device 180 also includes a plate 183 having openings 183*a* and 183*b* into which are inserted pins, screws or bolts, or nut and bolt combinations 185*a* and 185*b*, which fix the device 182 with respect to the plate 183. I.e. the pins or bolts of combinations 185*a* and 185*b* are inserted through slot 182*c* and then through openings 183*a* and 183*b*, respectively and tightened to hold the device 182 at a particular vertical position with respect to the plate 183. The plate 183 is fixed to a device 185 so that the plate 183 does not rotate with respect to the device 185. A cushion material 184 may be attached by velcro (trademarked) to the plate 183.

The device 185 may include a central portion 185*a* and flanges or protrusions 185*b* and 185*c* which may be at right angles with respect to the central portion 185*a*. A pin or rod 186 may connect the plate 183 to the protrusion 185*c*. The portion 185*a* is fixed to L brackets 187 and 188, via nut and bolt combinations 187*a* and 178*a* and via nut and bolt combination 189*a* the portion 185*a* is fixed to the member 22, thereby fixing the device 180 to the member 22.

Figure 7C:
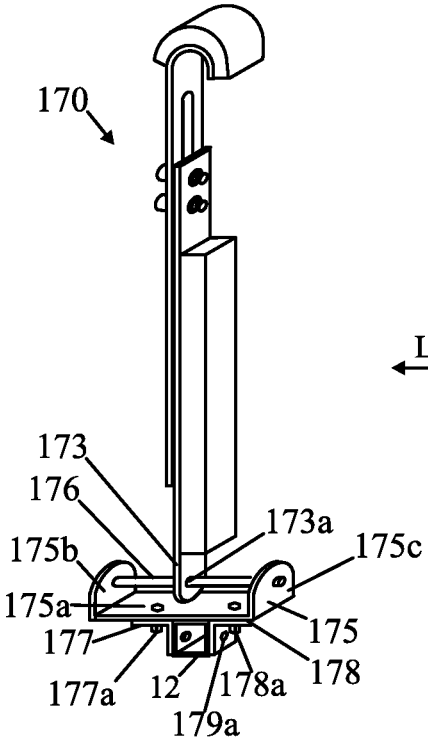
FIG. 7C shows a top, front, right perspective view of the first device of FIG. 7A, of the two devices for keeping dumbbells stable, with the first device of FIG. 7A shown in a state where part of the first device has been slid over to the left, with respect to another part of the first device.
Figure 14:
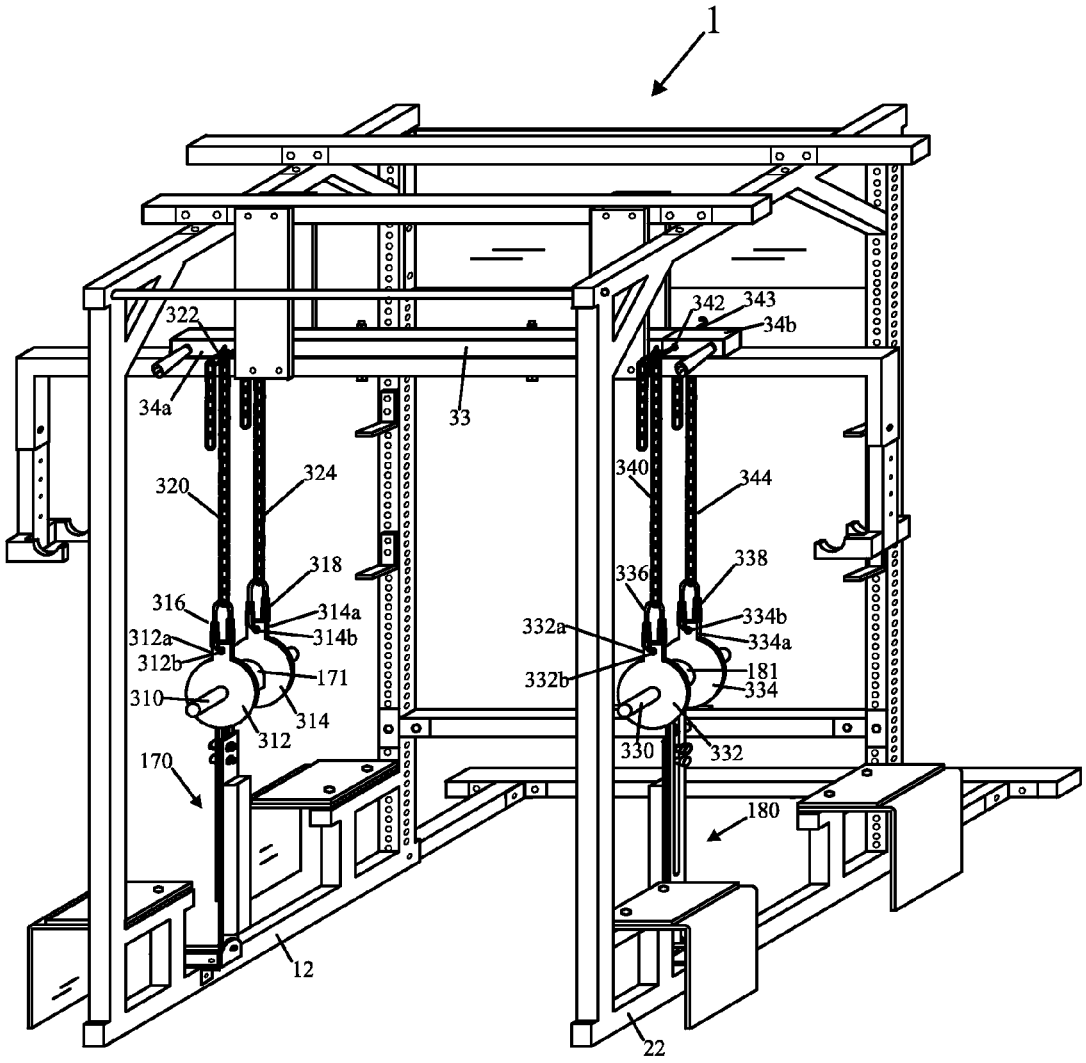
FIG. 14 shows a top, front, right perspective view of the apparatus of FIG. 1A along with first and second dumbbells and first and second devices, respectively, to keep the dumbbells from falling, and along with the two devices to keep the dumbbells stable.

FIG. 7C shows a top, front, right perspective view of the first device 170 of FIG. 7A, of the two devices (170 and 180) for keeping dumbbells stable, with the first device 170 is shown in a state where part of the first device 170, including plate 173 has been slid over to the left in the direction L1, with respect to another part of the device 170, such as with respect to device 175. The plate 173 has an opening 173*a* and the rod 176 slides in the opening 173*a* to allow the plate 173 to slide in the direction L1, from the state of FIG. 7A, along the rod 176. This allows for different dumbbell 310 horizontal positions, and can be done in conjunction with sliding member 34*a*, shown in FIG. 1B, to which hook 322 can be attached as shown in FIG. 14. From the state shown in FIG. 7C the plate 173 can be slid in the direction L1 (to the left) until plate 173 contacts member or plate 175*b* or in the direction R1 (to the right) until plate 173 contacts member or plate 175*c*.

Figure 7D:
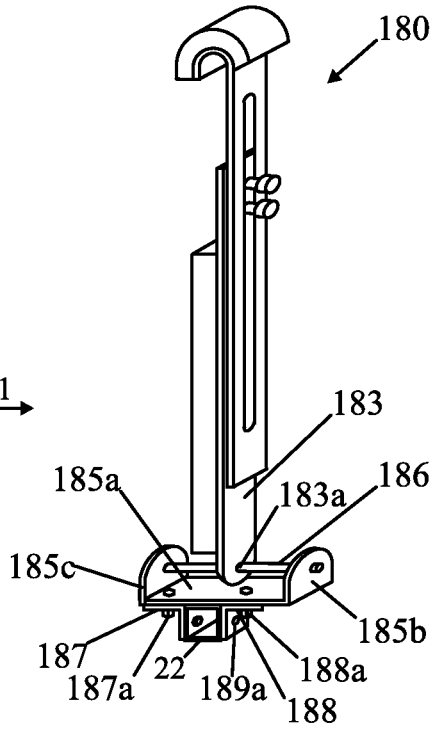
FIG. 7D shows a top, front, right perspective view of the second device of FIG. 7B, of the two devices for keeping dumbbells stable, with the second device of FIG. 7B shown in a state where part of the second device has been slid over to the right, with respect to another part of the first device.

Similarly, FIG. 7D shows a top, front, right perspective view of the second device 180 of FIG. 7B, of the two devices (170 and 180) for keeping dumbbells stable, with the second device 180 is shown in a state where part of the second device 180, including plate 183 has been slid over to the right in the direction R1, with respect to another part of the device 180, such as with respect to device 185. The plate 183 has an opening 183*a* and the rod 186 slides in the opening 183*a* to allow the plate 183 to slide in the direction R1, from the state of FIG. 7B, along the rod 186. This allows for different dumbbell 330 horizontal positions, and can be done in conjunction with sliding member 34*b*, shown in FIG. 1B, to which hook 342 can be attached as shown in FIG. 14. From the state shown in FIG. 7D the plate 183 can be slid in the direction L1 (to the left) until plate 183 contacts member or plate 185*c* or in the direction R1 (to the right) until plate 183 contacts member or plate 185*b*.

Figure 16A:
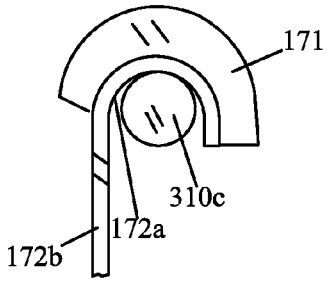
FIG. 16A shows a close up cross sectional view of part of a first dumbbell stabilizing device and part of a first dumbbell.
Figure 16B:
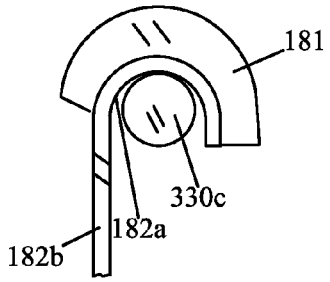
FIG. 16B shows a close up cross sectional view of part of a second dumbbell stabilizing device and part of a second dumbbell.
Figure 18A:
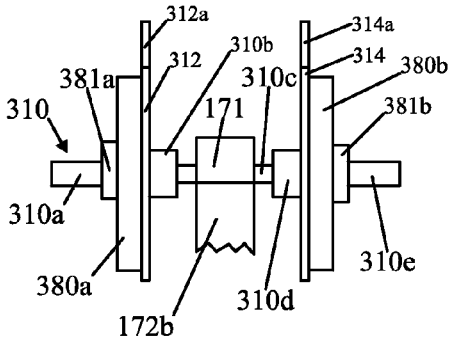
FIG. 18A shows a side view of part of the first dumbbell stabilizing device, the first dumbbell, two weights, two clips, and parts of the device for keeping the first dumbbell from falling.
Figure 18B:
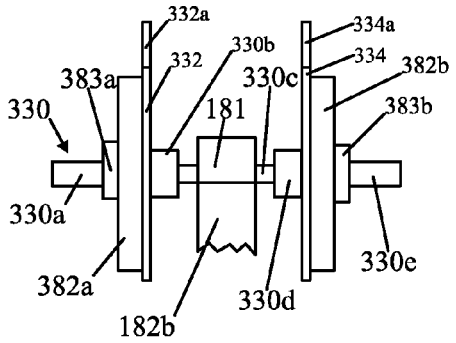
FIG. 18B shows a side view of part of the second dumbbell stabilizing device, the second dumbbell, two weights, two clips, and parts of the device for keeping the second dumbbell from falling.

FIG. 16A shows a close up cross sectional view of part of a first dumbbell stabilizing device 170 and part 310*c* of a first dumbbell 310. FIG. 16B shows a close up cross sectional view of part of a second dumbbell stabilizing device 180 and part 330*c* of a second dumbbell 330. FIG. 17A shows a side view of the first dumbbell 310. FIG. 17B shows a side view of the second dumbbell 330. FIG. 18A shows a side view of part of the first dumbbell stabilizing device 170, the first dumbbell 310, two weights 380*a* and 380*b*, two clips 381*a* and 381*b*, and parts of the device for keeping the first dumbbell from falling (members 312 and 314). FIG. 18B shows a side view of part of the second dumbbell stabilizing device 180, the second dumbbell 330, two weights 382*a* and 382*b*, two clips 381*a* and 381*b*, and parts of the device for keeping the second dumbbell from falling (332 and 334).

As shown by FIG. 16A, the arced or curved portion 172*a* of the device 170 sits on top of and substantially surrounds the dumbbell central portion 310*c* (i.e. the portion where someone would grips the dumbbell 310 with their hand to lift the dumbbell 310). Similarly, as shown by FIG. 16B, the arced or curved portion 182*a* of the device 180 sits on top of and substantially surrounds the dumbbell central portion 330*c* (i.e. the portion where someone grips the dumbbell 330 with their hand to lift the dumbbell 310).

The dumbbell 310 may be a conventional or olympic (trademarked) style dumbbell. The dumbbell 310 may have portions 310*a*, 310*b*, 310*c*, 310*d*, and 310*e*. The central portion 310*c* may have a width of D3 shown in FIG. 17A. The portions 310*a-e* may all be solid cylinders. The portions 310*b* and 310*d* have a higher diameter than the portion 310*c* to keep weights on the dumbbell 310 from sliding into the central portion (or hand grip portion) 310*c*. The portion 310*a* and 310*e* provide an appropriate diameter to provide a close fit for olympic (trademarked) style weights.

The dumbbell 330 may be identical to the dumbbell 310. The dumbbell 330 may be a conventional or olympic (trademarked) style dumbbell. The dumbbell 330 may have portions 330*a*, 330*b*, 330*c*, 330*d*, and 330*e*. The central portion 330*c* may have a width of D3 shown in FIG. 17B. The portions 330*a-e* may all be solid cylinders. The portions 330*b* and 330*d* have a higher diameter than the portion 330*c* to keep weights on the dumbbell 330 from sliding into the central portion (or hand grip portion) 330*c*. The portion 330*a* and 330*e* provide an appropriate diameter to provide a close fit for olympic (trademarked) style weights.

In FIG. 18A, the curved or arced portion 172*a* of the device 170 has been placed over the dumbbell portion 310*c* as in FIG. 16A, but only the cushion portion 171 and the straight portion 172*b* can be seen from the view of FIG. 18A. Weights 380*a* and 380*b* have been placed on portions 310*a* and 310*e* and clips 381*a* and 381*b* have been placed on the portions 310*a* and 310*e*, respectively. In addition the member 312 is shown on the portion 310*a*, between the portions 310*b*, and the weight 380*a*, The member 312 has an inner diameter which is larger than the diameter of the portion 310*a* but smaller than the diameter of the portion 310*b*. The member 312 can freely rotate to allow the chain 320 (see FIG. 14) to move inward towards the weight lifter (i.e typically into the interior of the apparatus 1) or outward, within a certain range, to allow greater freedom of movement. The oval structures 316 and 318 (see FIG. 14). can also rotate to allow create freedom of movement. Similarly, the member 314 is shown on the portion 310*e*, between the portions 310*d*, and the weight 380*b*, The member 314 has an inner diameter which is larger than the diameter of the portion 310*e* but smaller than the diameter of the portion 310*d*. The member 314 can freely rotate to allow the chain 324 (see FIG. 14) to move inward towards the weight lifter (i.e typically into the interior of the apparatus 1) or outward, within a certain range, to allow greater freedom of movement. The oval structures 316 and 318 (see FIG. 14). can also rotate to allow create freedom of movement.

In FIG. 18B, the curved or arced portion 182*a* of the device 180 has been placed over the dumbbell portion 330*c* as in FIG. 16B, but only the cushion portion 181 and the straight portion 182*b* can be seen from the view of FIG. 18B. Weights 382*a* and 382*b* have been placed on portions 330*a* and 330*e* and clips 383*a* and 383*b* have been placed on the portions 330*a* and 330*e*, respectively. In addition the member 332 is shown on the portion 330*a*, between the portions 330*b*, and the weight 320*a*, The member 332 has an inner diameter which is larger than the diameter of the portion 330*a* but smaller than the diameter of the portion 330*b*. The member 314 can freely rotate to allow the chain 340 (see FIG. 14) to move inward towards the weight lifter (i.e typically into the interior of the apparatus 1) or outward, within a certain range, to allow greater freedom of movement. In addition the member 334 is shown on the portion 330*e*, between the portions 330*d*, and the weight 382*b*, The member 334 has an inner diameter which is larger than the diameter of the portion 330*e* but smaller than the diameter of the portion 330*d*. The member 334 can freely rotate to allow the chain 344 (see FIG. 14) to move inward towards the weight lifter (i.e typically into the interior of the apparatus 1) or outward, within a certain range, to allow greater freedom of movement. The oval structures 336 and 338 (see FIG. 14) can also rotate to allow create freedom of movement.

Figure 4:
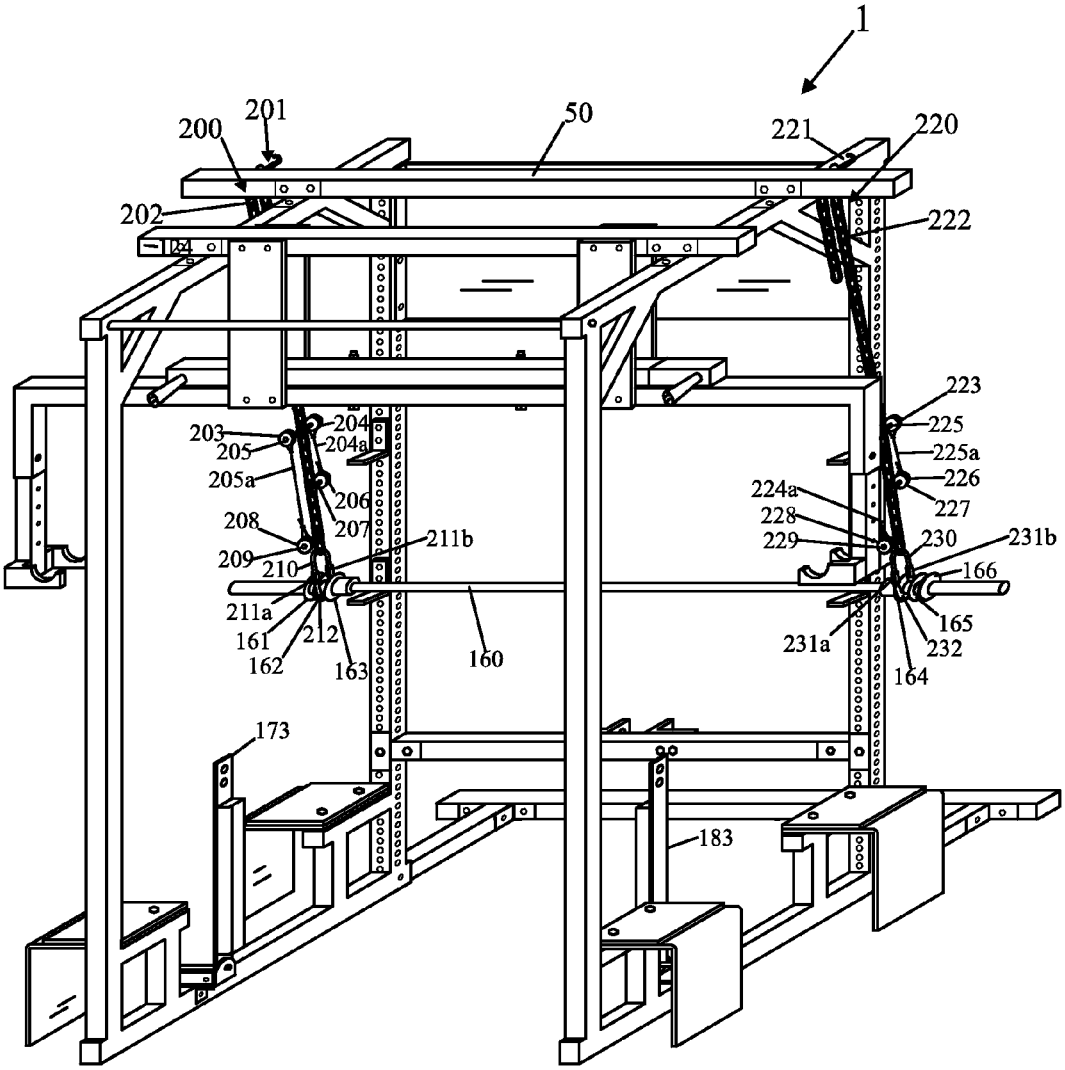
FIG. 4 shows a top, front, right perspective view of the apparatus of FIG. 1A along with the barbell, two other devices for keeping the barbell from falling, and a portion of the two devices for keeping dumbbells stable.

FIG. 4 shows a top, front, right perspective view of the apparatus 1 along with the barbell 160 two other devices 200 and 220 for keeping the barbell 160 from falling, and a portion of the two devices for keeping dumbbells stable, including members or plates 173 and 183. Each of the devices 200 and 220 may be identical either of the devices 120 and 140 previously described with reference to FIG. 3. The device 200 may include components 201, 202, 203, 204, 204*a*, 205, 205*a*, 206, 207, 208, 209, 210, 211*a*, 211*b*, and 212 which may be identical to components 121, 122, 123, 124, 124*a*, 125, 125*a*, 126, 127, 128, 129, 130, 131*a*, 131*b*, and 132, respectively. The device 220 may include components 221, 222, 223, 224, 224*a*, 225, 225*a*, 226, 227, 228, 229, 230, 231*a*, 231*b*, and 232 which may be identical to components 121, 122, 123, 124, 124*a*, 125, 125*a*, 126, 127, 128, 129, 130, 131*a*, 131*b*, and 132, respectively.

The barbell 160, shown in FIGS. 3 and 4, may be an olympic style barbell as known. The barbell 160 may include a central or hand grip portion 160*a*, a portion 160*c*, a portion 160*b*, a portion 160*d*, and a portion 160*e*. The portions 160*b* and 160*d* have an outer diameter greater than a diameter of the portions 160*c* and 160*e*, which have an outer diameter greater than the hand grip portion 160*a*. In accordance with an embodiment of the present invention, washer shaped disks or thin cylinders 161, 162, 163, 164, 165, and 166, each with a central hole are inserted onto the portions 160*c* (161, 162, and 163 are inserted there) and 160*e* (164, 165, and 166 are inserted there) as shown in FIGS. 3 and 4.

The oval structure formed by U-shaped members 130 and 132 and connectors 131*a* and 131*b* are looped around the portion 160*c* between the cylinders 161 and 162 in FIG. 3. The oval structure formed by U-shaped members 150 and 152 and connectors 151*a* and 151*b* are looped around the portion 160*e* between the cylinders 165 and 166 in FIG. 3. The oval structure formed by U-shaped members 210 and 212 and connectors 211*a* and 211*b* are looped around the portion 160*c* between the cylinders 162 and 163 in FIG. 4. The oval structure formed by U-shaped members 230 and 232 and connectors 231*a* and 231*b* are looped around the portion 160*e* between the cylinders 164 and 165 in FIG. 3.

Figure 5:
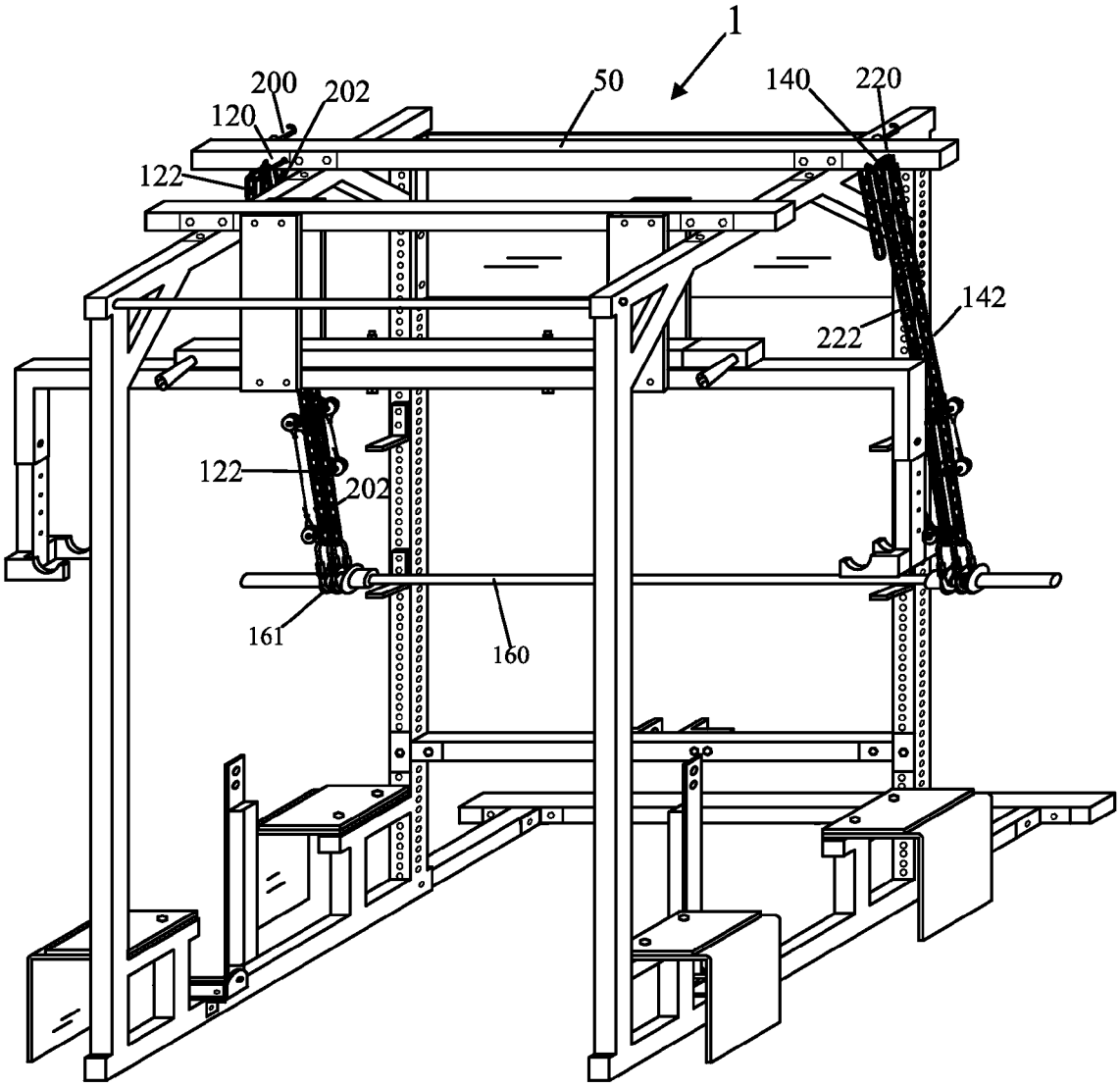
FIG. 5 shows a top, front, right perspective view of the apparatus of FIG. 1A along with the barbell, the four devices for keeping the barbell from falling, and the portion shown in FIG. 4 of the two devices for keeping dumbbells stable.

In this manner the barbell 160 is attached to the member or beam 50 by the chains 122, 202, 142 and 222 by the devices 120, 200, 140, and 220, respectively, to provide a safety feature so that the barbell 160 can be lifted off of two opposing supports brackets (of 100, 102, 104, and 106), and the barbell 160 will not fall and crush a person, for example, while doing bench presses. FIG. 5 shows the chains 122, 202, 142, and 222, and the devices 120, 200, 140, and 220 all connected to the barbell 160.

Figure 6:
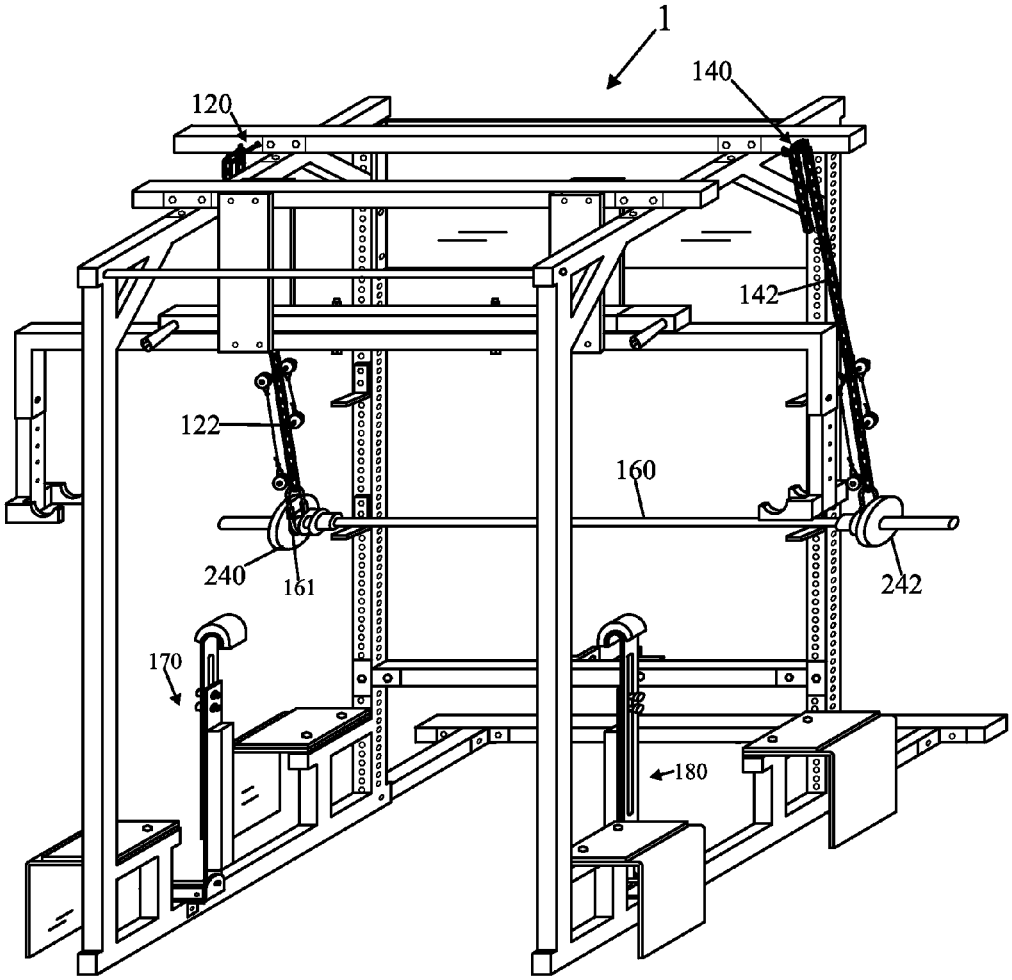
FIG. 6 shows a top, front, right perspective view of the apparatus of FIG. 1A along with the barbell, two devices for keeping the barbell from falling, two devices for keeping dumbbells stable, and a weight shown in each end of the barbell.

FIG. 6 shows a top, front, right perspective view of the apparatus 1 of FIG. 1A along with the barbell 160, two devices for keeping the barbell from falling, 120 and 140, two devices for keeping dumbbells stable 170 and 180, and a weight shown at each end of the barbell 160, namely weights 240 and 242. All four devices 120, 200, 140, and 200 would typically be used with barbell 160, however, FIG. 6 shows only two devices for clarity. Note that the weight 240 is placed on portion 160*c* after the outermost disk 161, and the weight 242 is placed on the portion 160*e* after the outermost disk 166, shown in FIG. 4.

Figure 9:
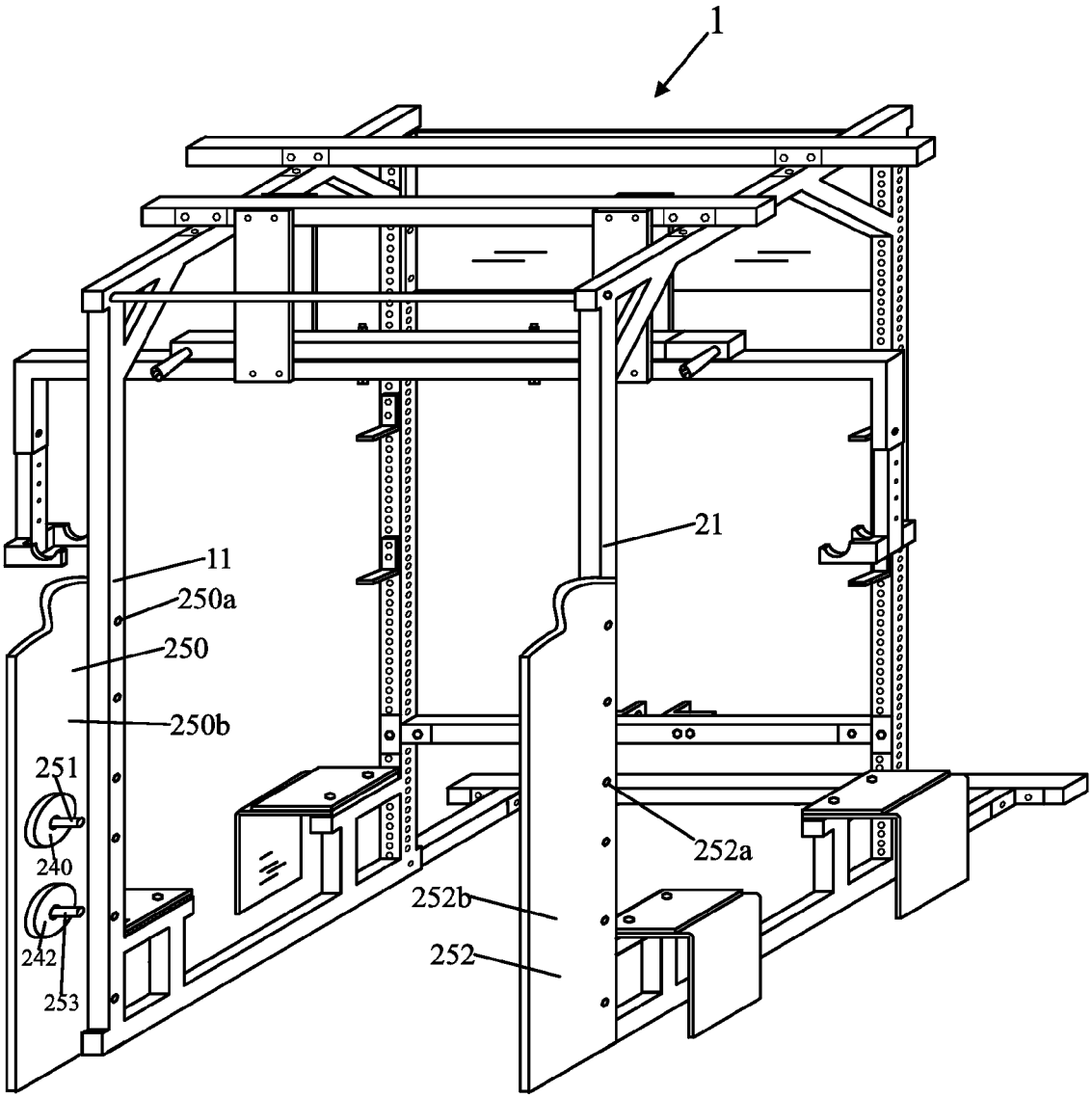
FIG. 9 shows a top, front, right perspective view of the apparatus of FIG. 1A along with additional shielding portions attached to the apparatus of FIG. 1A.

FIG. 9 shows a top, front, right perspective view of the apparatus 1 of FIG. 1A along with additional shielding portions 250 and 252 attached to the members 11 and 21 via nut and bolt combinations or screws 250*a* and 252*a*. The portions 250 and 252 can be used to provide a degree of privacy for a person working out or to provide surfaces 250*b* and 252*b* on which advertising can be placed. The portions 250 and 252 also provide stability, added strength and can be used for advertisement and weight plate storage as shown in FIG. 9. In FIG. 9, the posts or cylinders, members or rods 251 and 253 protrude out from the surface 250*b* and similar or identical rods may (not shown, protrude out from the surface 252*b*). The weights or circular disk weights 240 and 242, also shown in FIG. 6 can be placed on the rods 251 and 253, respectively. Additional weights can be placed on the rods 251 and 253 and similar rods (not shown) attached to member 252. Each of the rods 251 and 253 may have the same diameter as each of the portions 160*c* and 160*e* for the barbell 160 and as each of the portions 310*a* and 310*e* of the barbell 310, and each of the portions 312*a* and 312*e* of the barbell 312.

Figure 10:
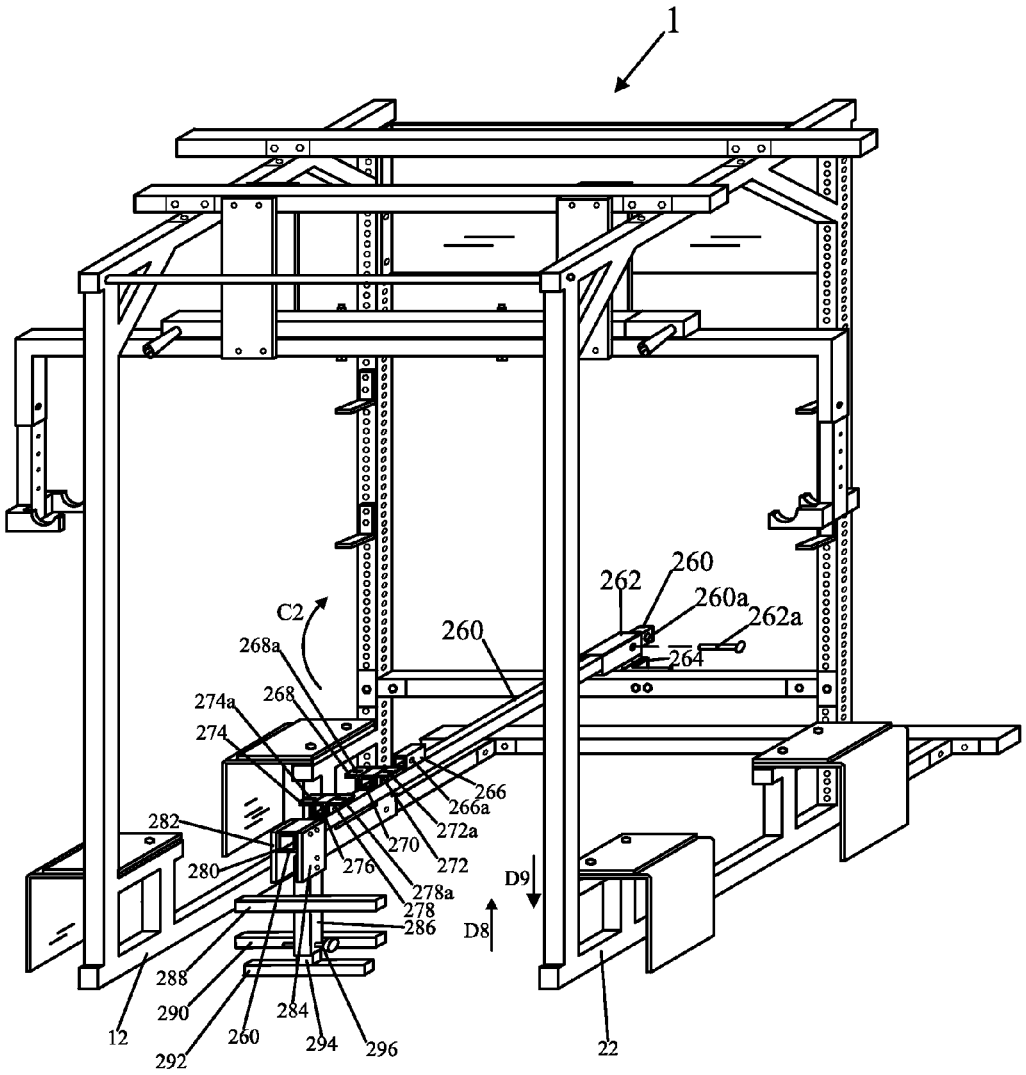
FIG. 10 shows a top, front, right perspective view of the apparatus of FIG. 1A along with a first set of portions of a bench apparatus.

FIG. 10 shows a top, front, right perspective view of the apparatus 1 of FIG. 1A along with a first set of portions of a bench apparatus. As shown in FIG. 10, the bench apparatus may include a beam or member 260, which is shown parallel to the member 12 and 22 in FIG. 10, but whose angle with respect to members 12 and 22 can be changed as will be described. The bench apparatus may also include a rectangular tubes 266, 270, and 276 which are fixed to a top of the member 260. The bench apparatus may also include L brackets 268 and 272 which are fixed to the tube 270 and L brackets 274 and 278 which are fixed to the tube 276. The L-brackets 268, 272, 274, and 278 have slots 268*a*, 272*a*, 274*a*, and 278*a* into which screws can be inserted to attach a bench seat 298 shown in FIG. 11 to the member or beam 260. The member 260 is fixed perpendicularly or substantially perpendicularly to a member 286, by a tube 280 (in which an end of the member 260 resides) and by plates 282 and 284 which are fixed to the tube 280 and the member 260 by nut and bolt combinations. The plates 282 and 284 are also fixed to the member 286 by nut and bolt combinations.

A member 294 can slide within a hollow cavity of the member 286 in the directions D8 and D9 when not fixed with respect to the member 286. A pin 296 can be used to set the member 294 at a vertical position in the cavity of the member 286. Members 288 and 290 are fixed, such as by welding to the member 286, substantially perpendicularly or perpendicularly. The member 294 is fixed to the member 292 substantially perpendicularly or perpendicularly.

In at least one embodiment, the member 286 may be fixed to the plates 284 and 282 by a pin 284*a* and a rod 284*b*. In at least one embodiment, the pin 284*a* can be removed and the member 286 can rotate about the pivot point of the rod 284*b* in the direction C3 (shown in FIG. 11) to bring the member 286 inward against the member 260 (shown in FIG. 10) under the seat portion 298 (shown in FIG. 11). In at least one embodiment, the member 286 does not rotate outward from the position shown in FIG. 12 in the direction C4 and is prevented from doing so by a stop plate (not shown) fixed to one or more of the plates 282 and 284 and/or underneath the tube 280, shown in FIG. 10. Rotating the member 286 in the direction C3 shown in FIG. 11 makes the bench apparatus more compact and makes transport of the bench apparatus components (such as 260, 282. 284, 286, and other components shown by FIGS. 10-12, but not shown in FIG. 1A) easier and keeps the members 260, 286, and other bench apparatus members out of the way when the member 260 of the bench apparatus is lifted up and clockwise in the direction C1 shown in FIG. 10 to make room for squat exercises or other exercises.

Figure 13A:
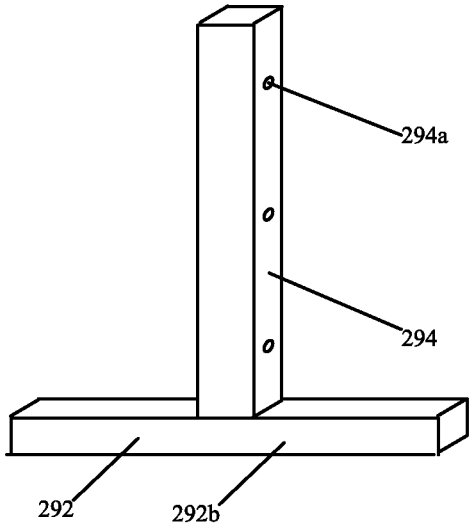
FIG. 13A shows a top, front, right perspective view of a first section of the bench apparatus.
Figure 13B:
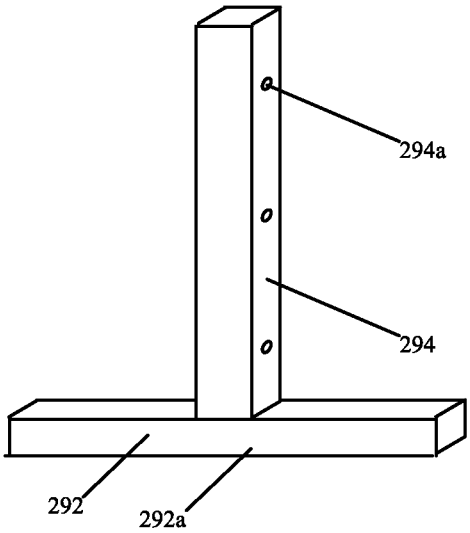
FIG. 13B shows a top, rear, left perspective view of the first section of the bench apparatus.

FIG. 13A shows a top, front, right perspective view of the member 294 fixed to the member 292, such as by welding. FIG. 13B shows a top, rear, left perspective view of the member 294 fixed to the member 292 such as by welding. The member 294 includes a plurality of openings 294*a* through which the pin 296 can be inserted to set the member 294 at different vertical height positions within a cavity of the member 286, which allows and end 298*a* of the seat 298 to be tilted upwards with respect to the beam or member 70. The members 294 and 292 and any other members of the apparatus 1 or of the bench apparatus may be made of a hard rigid material such as five gauge steel, in at least one embodiment.

Figure 11:
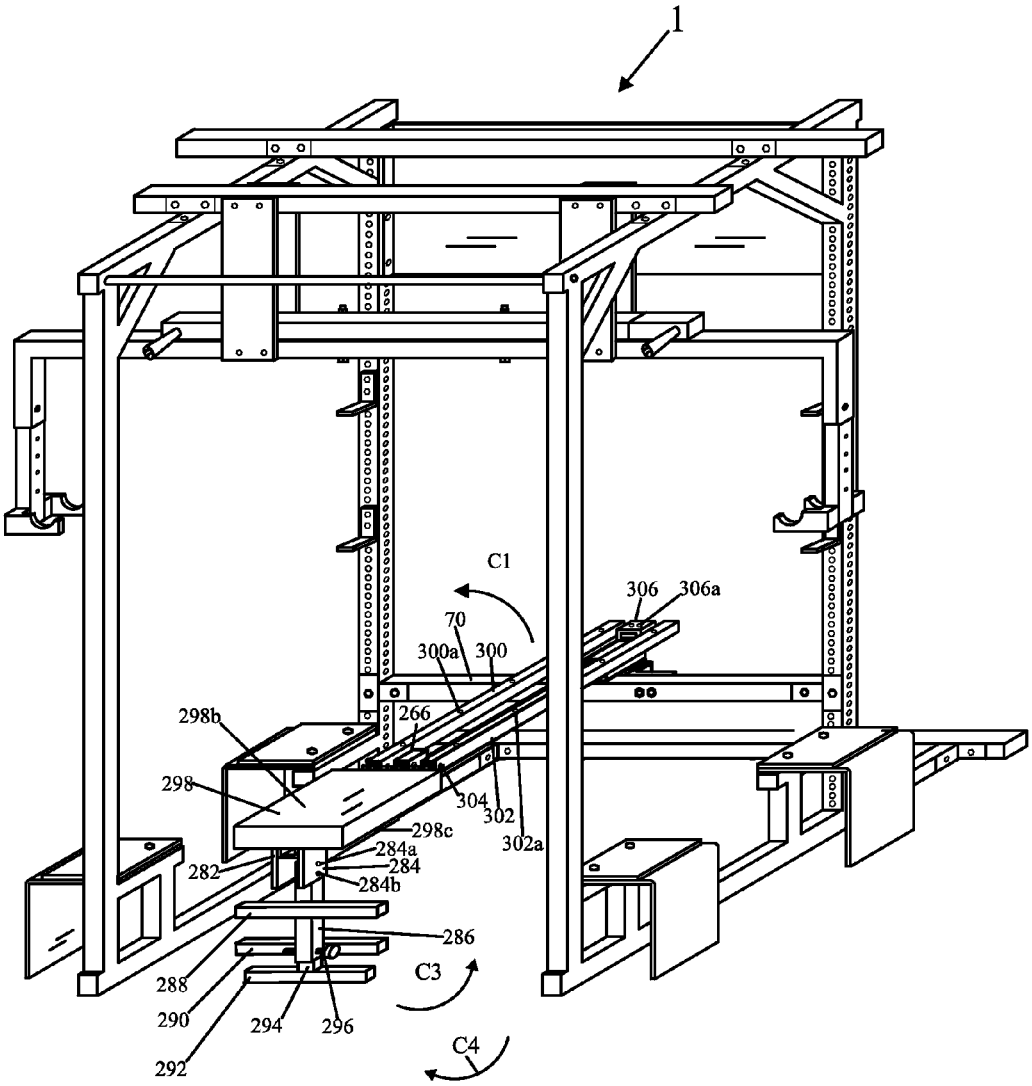
FIG. 11 shows a top, front, right perspective view of the apparatus of FIG. 1A along with a second set of portions of a bench apparatus.
Figure 12:
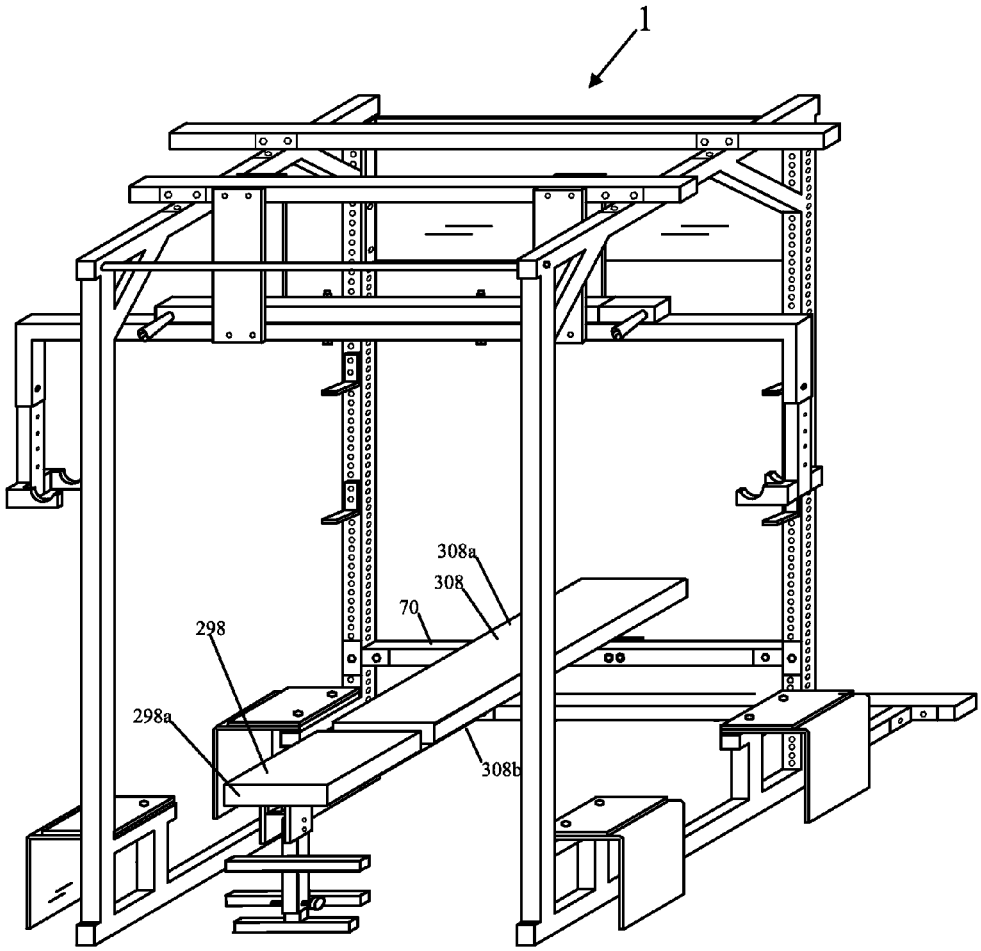
FIG. 12 shows a top, front, right perspective view of the apparatus of FIG. 1A along with a third set of portions of a bench apparatus.

FIG. 11 shows a top, front, right perspective view of the apparatus 1 of FIG. 1A along with a second set of portions of the bench apparatus. FIG. 11 shows the seat 298 which may include a cushion 298*b* on top and a backing 298*c* which is fixed to the L brackets 268, 272, 274, and 276. FIG. 11 also shows incline beams or members 300 and 302 and member 306. The member 306 is fixed to the back of the backing 308 shown in FIG. 12. The member 306 sits on tube 262 when the seat back 308 is down. Members 300 and 302 are pivotally attached to the member 266 by a pivot pin 304 going through aligned openings in 300, 266 (opening 266*a*) shown in FIGS. 10, and 302. The members 300 and 302 can pivot about the pin 304 with respect to the member 266 which remains fixed to the member 260 shown in FIG. 10. Thus the members 300 and 302 (shown in FIG. 11) can be parallel to the member 260 (shown in FIG. 10) or can be pivoted in the direction C1 shown in FIG. 11, to make an angle with the member 260 for an inclined bench exercise. The members 300 and 302 have openings 300*a* and 302*a* shown in FIG. 11 through which the members 300 and 302 can be fixed to the seat back 308 (which is shown in FIG. 12). The seat back 308 has a cushion 308*a* and a backing 308*b* shown in FIG. 12, to which the members 300 and 302 can be fixed. The cushion 308*a* is attached to the backing 308*b*.

A pin 262*a* can be inserted through an opening in the tube 262 and through an opening in member 260, to prevent the member 260 from sliding within the tube member 262. When not locked into place with pin 262*a* , the function of 260 is to slide through 262 in either direction. This allows the weightlifter to adjust the length of the bench based on their body size or different kinds of workouts. Another use for shortening the length of the bench is for lifting it up out of the way so it clears the barbell 160 (pivotting in the direction C2 shown in FIG. 10) when the weightlifter is performing squats and other leg exercises. The member or beam 260 can be pivoted in the direction C2 (shown in FIG. 10) about a pivot pin that goes through opening 71*a* of L-shaped bracket 72 (shown in FIG. 1A), the opening 73*a* of L-shaped bracket 74 (shown in FIG. 2), and an opening in member 264 (shown in FIG. 10), wherein member 264 is between the L-shaped bracket 72 and 74.

FIG. 14 shows a top, front, right perspective view of the apparatus 1 of FIG. 1A along with the first and second dumbbells 310 and 330 and first and second devices, respectively, to keep the dumbbells from falling, and along with the two devices 170 and 180 to keep the dumbbells 310 and 330, respectively stable, while an individual is changing weights on the dumbbells 310 and 330. FIG. 14 shows a chain 320 attached at one end to a hook 322 (which is fixed to member 34*a* which slides in member 33, to place chain 320 at different horizontal positions in conjunction with plate 173 shown in FIGS. 7A and 7C) and attached at an opposite end to an oval structure 316 similar or identical to the oval structure (comprised of 130, 131*a*, 131*b*, and 132) previously described with reference to FIG. 3. The oval structure 316 is connected to a protrusion 312*a* through an opening 312*b* of a member 312. The member 312 is typically a solid cylinder metal disk with the exception of protrusion 312*a* and opening 312*b*. The chain 320, hook 322, oval structure 316, and member 312 hold a portion of the dumbbell 310 up. The hook 322 may be made of heat treated steel to give 210,000 PSI (pounds per square inch steel). The hook 322 may be replaced by or may be anchor bolts with 70% back angle.

FIG. 14 shows a chain 324 which is attached at one end to a hook, which is attached to member 34*a* (hook not shown in FIG. 14, and member 34*a* slides within tube member 33 to place chain 324 at different horizontal positions in conjunction with plate 173 shown in FIGS. 7A and 7C) and attached at an opposite end to an oval structure 318 similar or identical to the oval structure (comprised of 130, 131*a*, 131*b*, and 132) previously described with reference to FIG. 3. The oval structure 318 is connected to a protrusion 314*a* through an opening 314*b* of a member 314. The member 314 is typically a solid cylinder metal disk with the exception of protrusion 314*a* and opening 314*b*. The chain 324, hook (not shown), oval structure 316, and member 314 hold a portion of the dumbbell 310 up, so that the two chains 320 and 324 hold the dumbbell 310 up in a balanced manner, i.e. with dumbbell 310 parallel to the member 12 (when the chains 320 and 324 are attached to hook 322 and similar hook attached to member 34*a* (which slides within the member 33) at the appropriate chain links.

FIG. 14 shows a chain 340 attached at one end to a hook 342 (which is fixed to the member 34*b* which slides within member 33, to place chain 340 at different horizontal positions in conjunction with plate 183 shown in FIGS. 7B and 7D) and attached at an opposite end to an oval structure 336 similar or identical to the oval structure (comprised of 130, 131*a*, 131*b*, and 132) previously described with reference to FIG. 3. The oval structure 336 is connected to a protrusion 332*a* through an opening 332*b* of a member 332. The member 332 is typically a solid cylinder metal disk with the exception of protrusion 332*a* and opening 332*b*. The chain 340, hook 342, oval structure 336, and member 332 hold a portion of the dumbbell 310 up.

FIG. 14 shows a chain 344 which is attached at one end to a hook 343 (which is attached to member 34*b* which slides within member 33, to place chain 344 at different horizontal positions in conjunction with plate 183 shown in FIG. 7B and 7D and attached at an opposite end to an oval structure 338 similar or identical to the oval structure (comprised of 130, 131*a*, 131*b*, and 132) previously described with reference to FIG. 3. The oval structure 338 is connected to a protrusion 334*a* through an opening 334*b* of a member 334. The member 334 is typically a solid cylinder metal disk with the exception of protrusion 334*a* and opening 334*b*. The chain 344, hook 343, oval structure 338, and member 334 hold a portion of the dumbbell 330 up, so that the two chains 340 and 344 hold the dumbbell 330 up in a balanced manner, i.e. with dumbbell 330 parallel to the member 22 when the chains 340 and 344 are attached to hook 342 and similar hook 343 attached to member 34*b* (which slides within the member 33) at the appropriate chain links.

FIG. 15 shows a top, front, right perspective view of the components shown in FIG. 14 and additionally shows devices attached to chains for keeping the chains out of a weightlifter's way, and also shows a weight 380*a* and 382*a* on the dumbbells 310 and 330, respectively. FIG. 15 shows components 345, 345*a*, 346*a*, 346, 347, 348, 349, 350, and 351 which are similar to or identical to the components 123, 123*a*, 124*a*, 124, 125, 126, 127, 128, and 129, respectively, shown in FIG. 20. FIG. 15 shows components 352, 352*a*, 356*a*, 353, 354, 355, 356, 357, and 358 which are similar to or identical to the components 123, 123*a*, 124*a*, 124, 125, 126, 127, 128, and 129, respectively, shown in FIG. 20.

FIG. 15 also shows components 365, 365*a*, 366*a*, 366, 367, 368, 369, 370, and 371 which are similar to or identical to the components 123, 123*a*, 124*a*, 124, 125, 126, 127, 128, and 129, respectively, shown in FIG. 20. FIG. 15 also shows components 372, 372*a*, 374*a*, 373, 374, 375, 376, 377, and 378 which are similar to or identical to the components 123, 123*a*, 124*a*, 124, 125, 126, 127, 128, and 129, respectively, shown in FIG. 20.

FIG. 19 shows a closeup front, top, right perspective view of the chain 320, on the hook 322. The chain 320 may include a plurality of chain links 321 including link 321*a*, 321*b*, and 321*c*. In accordance with an embodiment of the present invention at a first end 320*a* of the chain 320, the link 321*a* is labeled with the number "1" which can be attached to, printed on or engraved, or otherwise associated with the chain link 320*a*. The number "1" is shown upside down in FIG. 19, so that when attaching the appropriate chain link to hook 322 the number will be right side up. A link is skipped between numbers to allow for consistent orientation of a dumbbell such as 310 or barbell, such as 160, such links tend to orient themselves at angles, and it is better to skip a link. FIG. 19 shows upside down numbers "1", "2", "3", and "4" and right-side up numbers "5", "6", "7", "8", "9", "10", "11" and "12". In FIG. 19, the setting is "5" meaning that the chain link 321*b* has been placed on the hook 322 to set the height to a setting of "5". In at least one embodiment, the numbering of the links of chain 320 and other chains mentioned in this application, ends prior to the start of devices for attaching the spools, such as device 347 for attaching spools 345 and 346 shown in FIG. 15. I.e. only alternate links above the spools would be numbered with numbered settings. In this way one can see the numbered settings on the chain, such as chain 320. Note that the chain 320, and other chains may be longer than shown and may have more settings, and an example was given for descriptive purposes.

Figure 21:
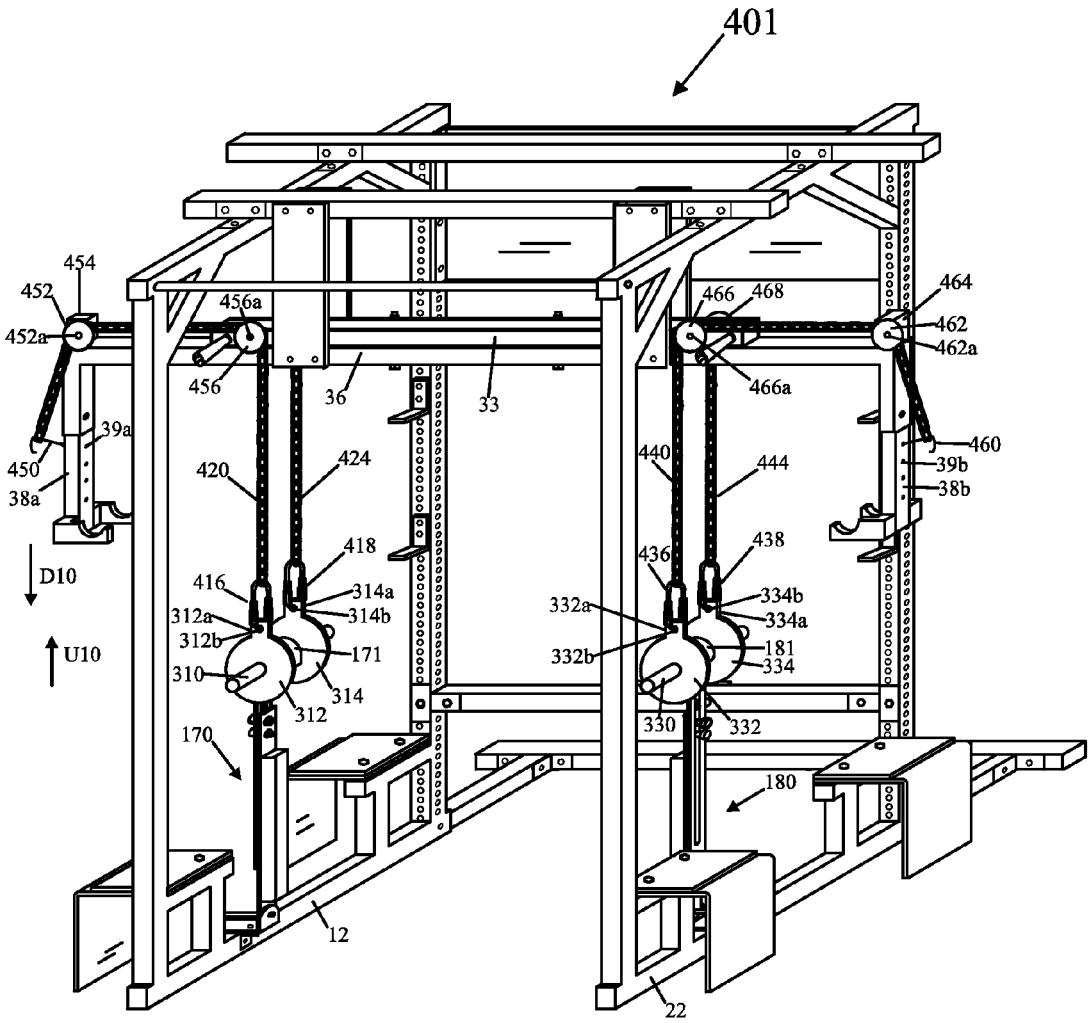
FIG. 21 shows a top, front, right perspective view of a modified apparatus, which may be the same as the apparatus of FIG. 1A, except as described, along with first and second dumbbells and first and second alternative devices, respectively, to keep the dumbbells from falling (i.e. hold the dumbbells up, suspended in air), and along with the two devices to keep the dumbbells stable.

FIG. 21 shows a top, front, right perspective view of a modified apparatus 401, which may be the same as the apparatus 1 of FIG. 1A, except as described, along with first and second dumbbells 310 and 330 and first and second alternative devices, respectively, to keep the dumbbells from falling (i.e. hold the dumbbells 310 and 330 up, suspended in air), and along with the two devices 170 and 180 to keep the dumbbells 310 and 330 stable. The first alternative device may include chains 420, 424, pulleys, spools or disks 452 and 456, and hook 450. One end of the chain 420 may be connected to the oval structure 416 (for holding up one end of the dumbbell 310), while the opposite end of the chain 420 is connected to the hook 450 which is fixed onto the member 38*a*, such as through one of the openings 39*a*. The chain 420 may pass over and through a channel of pulley or spool 456, and then over a channel of pulley or spool 452, and then be connected to hook 450. The pulley or spool 452 may be fixed to the member 454 through pin 452*a*. The member 454 may be fixed to the member 36. The pulley or spool 456 may be fixed to the member 33 or to member 34*a*, which slides through member 33, through pin 456*a*.

Similarly, one end of the chain 424 may be connected to the oval structure 418 (for holding up the other end of dumbbell 310), while the opposite end of the chain 424 is connected to either the hook 450 or another hook not shown, which is fixed onto the member 38*a*, such as through one of the openings 39*a*. The chain 424 may pass over and through a channel of a pulley or spool on the other side of member 33 (or of the member 34*a* which slides through member 33) not shown in FIG. 21, but would be opposite to pulley or spool 456, and then over a channel of pulley or spool on the other side of member 454, opposite pulley or spool 452, but not shown in FIG. 21, and then be connected to hook 450 or another hook not shown and thereby fixed to member 38*a*. The pulley or spool, not shown, opposite 452, on the other side of member 454 may be fixed to the member 454 through pin 452*a*. The pulley or spool on the other side of member 33, opposite pulley or spool 456 may be fixed to the member 33 through pin 456*a*, also.

In operation, an individual can release the end of chain 420 from the hook 450, and the end of chain 424 fixed either to hook 450 or a similar hook fixed to the member 38*a*, and then pull down in the direction D10 on both the released ends of chains 420 and 424 to cause the vertical height of the dumbbell 310 to be raised or moved closer to the member 33. The end of the chains 420 and 424 which would be near or attached to hook 450, can also be allowed to move in the direction U10, upwards, to cause the vertical height of the dumbbell 310 to be lowered. During raising or lowering operation of the dumbbell 310 in this embodiment, the chain 420 rolls on or slides on pulleys or spools 452 and 456; and the chain 424 rolls on or slides on analogous pulleys or spools not shown. The pulleys or spools 452 and 456 for chain 420, and analogous pulleys or spools for chain 424 may be fixed so they don't rotate or may be mounted so that they do rotate with respect to members 454 and 33, respectively.

The second alternative device may include chains 440, 444 pulleys, spools or disks 462 and 466, and hook 460. One end of the chain 440 may be connected to the oval structure 436 (for holding up one end of the dumbbell 330), while the opposite end of the chain 440 is connected to the hook 460 which is fixed onto the member 38*b*, such as through one of the openings 39*b*. The chain 440 may pass over and through a channel of pulley or spool 466 and then over a channel of pulley or spool 462 and then be connected to hook 460. The pulley or spool 462 may be fixed to the member 464 through pin 462*a*. The member 464 may be fixed to the member 36. The pulley or spool 466 may be fixed to the member 33 or the member 34*b* which slides through the member 33 through pin 466*a*.

Similarly, one end of the chain 464 may be connected to the oval structure 438 (for holding up the other end of dumbbell 330), while the opposite end of the chain 444 is connected to either the hook 460 or another hook not shown, which is fixed onto the member 38*b*, such as through one of the openings 39*b*. The chain 444 may pass over and through a channel of a pulley or spool 468 on the other side of member 33, opposite to pulley or spool 466, and then over a channel of pulley or spool on the other side of member 464, opposite pulley or spool 462, but not shown in FIG. 21, and then be connected to hook 460 or another hook not shown and thereby fixed to member 38*b*. The pulley or spool, not shown, opposite 462, on the other side of member 464 may be fixed to the member 464 through pin 462*a*. The pulley or spool on the other side of member 33, opposite pulley or spool 466 may be fixed to the member 33, (or to the member 34*b*, which slides through the member 33) through pin 466*a*, also.

In operation, an individual can release the end of chain 440 from the hook 460, and the end of chain 464 fixed either to hook 460 or a similar hook fixed to the member 38*b*, and then pull down in the direction D10 on both the released ends of chains 440 and 444 to cause the vertical height of the dumbbell 330 to be raised or moved closer to the member 33. The end of the chains 440 and 444 which would be near or attached to hook 460, can also be allowed to move in the direction U10, upwards, to cause the vertical height of the dumbbell 330 to be lowered. During raising or lowering operation of the dumbbell 330 in this embodiment, the chain 440 rolls on or slides on pulleys or spools 462 and 466; and the chain 444 rolls on or slides on analogous pulleys or spools not shown. The pulleys or spools 462 and 466 for chain 440, and analogous pulleys or spools for chain 444 may be fixed so they don't rotate or may be mounted so that they do rotate with respect to members 464 and 33, respectively.

The oval structures 416, 418, 436, and 438 may be identical to the oval structures 316, 318, 336, and 338, respectively, previously described with reference to FIG. 14. The apparatus 401 can be used with the devices or components shown in FIG. 20 and/or FIG. 15, which can be used to prevent the chains 420, 424, 440, and 444 from getting in a weightlifters way or from dropping below a vertical height of a dumbbell 310 or 330 and thereby undesirably adding to the weight of the dumbbells 310 and/or 330.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

first, second, third, and fourth vertical members;

a first top horizontal member which joins a top of the first and a top of the second vertical members;

a second top horizontal member which joins a top of the third and a top of the fourth vertical members;

a third top horizontal member which joins a top of the first top horizontal member and a top of the second top horizontal member;

wherein the first, second, third, and fourth vertical members, and the first, second, and third top horizontal members form a cage structure;

a first dumbbell holder member adjustably fixed to the cage structure;

a second dumbbell holder member adjustably fixed to the cage structure;

wherein the first dumbbell holder member includes a curved portion onto which a central portion of a first dumbbell can be placed;

wherein the second dumbbell holder member includes a curved portion onto which a central portion of a second dumbbell can be placed;

and further comprising a device for adjusting a position of the first dumbbell holder member with respect to the cage structure;

and a device for adjusting a position of the second dumbbell holder member with respect to the cage structure; and further comprising a fourth horizontal member fixed to the third horizontal member, such that the third horizontal member is at one vertical height and the fourth horizontal member is substantially parallel to the third horizontal member and at a different vertical height;

wherein the fourth horizontal member is fixed to the cage structure through the third horizontal member but is not otherwise fixed to the cage structure;

and further comprising a fifth horizontal member which is inserted into a first end of the fourth horizontal member and a sixth horizontal member which is inserted into a second end of the fourth horizontal member so that the fifth horizontal member and the sixth horizontal member telescope inside of the fourth horizontal member;

wherein the fifth horizontal member is configured to be attached to a first device for suspending a first dumbbell from the cage structure, through the fifth horizontal member, wherein the first device for suspending the first dumbbell is not attached to the cage structure other than through the fifth horizontal member, so that sliding the fifth horizontal member, while a portion of the fifth horizontal member is within the fourth horizontal member causes the first device for suspending the first dumbbell to slide; and wherein the sixth horizontal member is configured to be attached to a second device for suspending a second dumbbell from the cage structure, through the sixth horizontal member, wherein the second device for suspending the second dumbbell is not attached to the cage structure other than through the sixth horizontal member, so that sliding the sixth horizontal member while a portion of the sixth horizontal member is within the fourth horizontal member causes the second device for suspending the first dumbbell to slide.

2. The apparatus of claim 1 further comprising a first step structure fixed to the cage structure, so that a person can stand on the first step structure and adjust the position of the first dumbbell holder; and a second step structure fixed to the cage structure, so that a person can stand on the second step structure and adjust the position of the first dumbbell holder.

3. The apparatus of claim 1 wherein wherein the first dumbbell holder member and the second dumbbell holder member are configured with respect to each other so that the first dumbbell and the second dumbbell can be adjusted to be at the same vertical height, not colinear, spaced apart from each other, and parallel to each other, when the first dumbbell is held by the first dumbbell holder member and the second dumbbell is held by the second dumbbell holder member;

wherein the apparatus include a first tube and a second tube;

the first dumbbell holder member includes a first portion which slides in the first tube in order to adjust a vertical height of the first dumbbell holder member; and the second dumbbell holder member includes a second portion which slides in the second tube in order to adjust a vertical height of the second dumbbell holder member.

4. The apparatus of claim 1 wherein the device for suspending the first dumbbell from the cage structure includes a first pyramid shaped component which is fixed to the fifth horizontal member; and the device for suspending the second dumbbell from the cage structure includes a second pyramid shaped component which is fixed to the sixth horizontal member.

5. An apparatus comprising first, second, third, and fourth vertical members;

a first top horizontal member which joins a top of the first and a top of the second vertical members;

a second top horizontal member which joins a top of the third and a top of the fourth vertical members;

a third top horizontal member which joins a top of the first top horizontal member and a top of the second top horizontal member;

wherein the first, second, third, and fourth vertical members, and the first, second, and third top horizontal members form a cage structure;

a first device for suspending a first dumbbell from the cage structure;

a second device for suspending a second dumbbell from the cage structure;

a first device for maintaining the first dumbbell in a stable state while the first dumbbell is suspended from the cage structure and while a person is taking one or more weights off the second dumbbell; and wherein the first device for suspending the first dumbbell from the cage structure include a first sliding member which is connected to the cage structure so that the first sliding member can slide substantially parallel to the first, second, and third top horizontal members.

6. The apparatus of claim 5 further comprising a device for suspending a barbell from the cage structure.

7. The apparatus of claim 5 wherein the second device for suspending the second dumbbell from the cage structure includes a second sliding member which is connected to the cage structure so that the second sliding member can slide substantially parallel to the first, second, and third top horizontal members.

8. An apparatus comprising first, second, third, and fourth vertical members;

a first top horizontal member which joins a top of the first and a top of the second vertical members;

a second top horizontal member which joins a top of the third and a top of the fourth vertical members;

a third top horizontal member which joins a top of the first top horizontal member and a top of the second top horizontal member;

wherein the first, second, third, and fourth vertical members, and the first, second, and third top horizontal members form a cage structure;

a device for suspending a first dumbbell from the cage structure;

a device for suspending a second dumbbell from the cage structure;

a first device for maintaining the first dumbbell in a stable state while the first dumbbell is suspended from the cage structure and while a person is taking one or more weights off of the first dumbbell; and a second device for maintaining the second dumbbell in a stable state while the second dumbbell is suspended from the cage structure and while a person is taking one or more weights off of the second dumbbell;

wherein the first device for suspending the first dumbbell from the cage structure includes a first chain and a second chain;

the first device for suspending the first dumbbell form the cage structure includes a first elastic cord having first and second ends, the first end of the first elastic cord attached to the first chain at a first location, the second end of the first elastic cord attached to the first chain at a second location, differing from the first location;

the first device for suspending the first dumbbell from the cage structure includes a second elastic cord having first and second ends, the first end of the second elastic cord attached to the second chain at a third location, the second end of the second elastic cord attached to the second chain at a fourth location, differing from the third location;

the second device for suspending the second dumbbell from the cage structure includes a third chain and a fourth chain;

the second device for suspending the second dumbbell from the cage structure includes a third elastic cord having first and second ends, the first end of the third elastic cord attached to the third chain at a fifth location, the second end of the third elastic cord attached to the third chain at attached location, differing from the fifth location; and the second device for suspending the second dumbbell from the cage structure includes a fourth elastic cord having first and second ends, the first end of the fourth elastic cord attached to the fourth chain at a seventh location, the second end of the fourth elastic cord attached to the fourth chain at an eighth location, differing from the seventh location.

9. The apparatus of claim 8 wherein the first device for suspending the first dumbbell from the cage structure includes a fifth elastic cord having first and second ends, the first end of the fifth elastic cord attached to the first chain at a ninth location, the second end of the fifth elastic cord attached to the first chain at a tenth location, differing from the ninth location;

the first device for suspending the first dumbbell from the cage structure includes a sixth elastic cord having first and second ends, the first end of the sixth elastic cord attached to the second chain at an eleventh location, the second end of the sixth elastic cord attached to the second chain at a twelfth location, differing from the eleventh location;

a second device for suspending the second dumbbell from the cage structure includes a seventh elastic cord having first and second ends, the first end of the seventh elastic cord attached to the third chain at a thirteenth location, the second end of the seventh elastic cord attached to the third chain at a fourteenth location, differing from the thirteenth location;

the second device for suspending the second dumbbell from the cage structure includes a eighth elastic cord having first and second ends, the first end of the eighth elastic cord attached to the fourth chain at an fifteenth location, the second end of the eighth elastic cord attached to the fourth chain at a sixteenth location, differing from the fifteenth location.

10. The apparatus of claim 8 further comprising a first dumbbell holder member adjustably fixed to the cage structure;

a second dumbbell holder member adjustably fixed to the cage structure;

wherein the first dumbbell holder member includes a curved portion onto which a central portion of a first dumbbell can be placed;

wherein the second dumbbell holder member includes a curved portion onto which a central portion of a second dumbbell can be placed;

and further comprising a first device for adjusting a position of the first dumbbell holder member with respect to the cage structure;

and a second device for adjusting a position of the second dumbbell holder member with respect to the cage structure;

wherein the first dumbbell holder member and the second dumbbell holder member are configured with respect to each other so that the first dumbbell and the second dumbbell can be adjusted to be at the same vertical height, not colinear, spaced apart from each other, and parallel to each other, when the first dumbbell is held by the first dumbbell holder member and the second dumbbell is held by the second dumbbell holder member;

wherein the apparatus includes a first tube and a second tube;

wherein the first dumbbell holder member includes a first portion which slides in the first tube in order to adjust a vertical height of the first dumbbell holder member; and wherein the second dumbbell holder member includes a second portion which slides in the second tube in order to adjust a vertical height of the second dumbbell holder member.

11. An apparatus comprising first, second, third, and fourth vertical members;

a first top horizontal member which joins a top of the first and a top of the second vertical members;

a second top horizontal member which joins a top of the third and a top of the fourth vertical members;

a third top horizontal member which joins a top of the first top horizontal member and a top of the second top horizontal member;

wherein the first, second, third, and fourth vertical members, and the first, second, and third top horizontal members form a cage structure;

a first device for suspending a first dumbbell from the cage structure;

a second device for suspending a second dumbbell from the cage structure;

a first device for maintaining the first dumbbell in a stable state while the first dumbbell is suspended from the cage structure and while a person is taking one or more weights off the second dumbbell; further comprising the first device for suspending the first dumbbell in a stable state while the first dumbbell is suspended from the cage structure and while a person is taking one or more weights off of the first dumbbell includes a first curved portion which is configured to wrap around a central portion of the first dumbbell;

the second device for suspending the second dumbbell in a stable state while the second dumbbell is suspended from the cage structure and while a person is taking one or more weights off of the second dumbbell includes a second curved portion which is configured to wrap around a central portion of the second dumbbell.

12. The apparatus of claim 11 wherein the first curved portion is fixed to a first plate having a first elongated slot;

the second curved portion is fixed to a second plate having a second elongated slot;

the first dumbbell for maintaining the first dumbbell in a stable state while the first dumbbell is suspended from the cage structure and while a person is taking one or more weights off of the first dumbbell includes a third plate to which the first plate is adjustably connected through the first elongated slot so that the first plate can be adjusted in height with respect to the third plate, and wherein the third plate is fixed to the cage structure;

the second device for maintaining the second dumbbell in a stable state while the second the device for maintaining the second dumbbell in a stable state while the second dumbbell is suspended from the cage structure and while a person is taking one or more weights off of the second dumbbell includes a fourth plate to which the second plate is adjustably connected through the second elongated slot so that the second plate can be adjusted in height with respect to the fourth plate, and wherein the fourth plate is fixed to the cage structure.

13. The apparatus of claim 12 wherein the third plate is fixed to the cage structure so that the third plate can slide substantially parallel to the first, second, and third top horizontal members to set the first curved portion at different horizontal locations; and the fourth plate is fixed to the cage structure so that the fourth plate can slide substantially parallel to the first, second, and third top horizontal members to set the second curved portion at different horizontal locations.

14. An apparatus comprising first, second, third, and fourth vertical members;

a first top horizontal member which joins a top of the first and a top of the second vertical members;

a second top horizontal member which joins a top of the third and a top of the fourth vertical members;

a third top horizontal member which joins a top of the first top horizontal member and a top of the second top horizontal member;

wherein the first, second, third, and fourth vertical members, and the first, second, and third top horizontal members form a cage structure;

and further comprising a bench apparatus which is connected to the cage structure so that the bench apparatus can slide with respect to the cage structure;

wherein the bench apparatus includes a front support which supports a front portion of the bench apparatus, when a bottom of the front support is on a ground surface while an opposite rear portion of the bench apparatus is supported by the cage structure; and wherein the front support is connected to the front portion of the bench apparatus, so that the front support can be put in a state where the front support rotates with respect to the front portion of the bench apparatus.

15. The apparatus of claim 14 wherein the bench apparatus is connected to the cage structure so that the bench apparatus can be rotated with respect to the cage structure.

16. The apparatus of claim 15 further comprising a chin up bar member;

wherein the cage structure and the bench apparatus are configured with respect to each other so that the chin up bar member can be placed in a first position, fixed to the cage structure, wherein the first position is above the head of an average human being so that the average human being can do chin ups;

and wherein the cage structure and the bench apparatus are configured with respect to each other so that the chin up bar member can be placed in a second position, held off of the ground by the cage structure, in which a weightlifting bench seatback portion of the bench apparatus is held in an orientation which is at an angle with respect to the first, second, and third top horizontal members.

17. The apparatus of claim 14 further comprising a first dumbbell holder member adjustably fixed to the cage structure;

a second dumbbell holder member adjustably fixed to the cage structure;

wherein the first dumbbell holder member includes a curved portion onto which a central portion of a first dumbbell can be placed;

wherein the second dumbbell holder member includes a curved portion onto which a central portion of a second dumbbell can be placed;

and further comprising a first device for adjusting a position of the first dumbbell holder member with respect to the cage structure;

and a second device for adjusting a position of the second dumbbell holder member with respect to the cage structure;

wherein the first dumbbell holder member and the second dumbbell holder member are configured with respect to each other so that the first dumbbell and the second dumbbell can be adjusted to be at the same vertical height, not colinear, spaced apart from each other, and parallel to each other, when the first dumbbell is held by the first dumbbell holder member and the second dumbbell is held by the second dumbbell holder member;

wherein the apparatus includes a first tube and a second tube;

wherein the first dumbbell holder member includes a first portion which slides in the first tube in order to adjust a vertical height of the first dumbbell holder member; and wherein the second dumbbell holder member includes a second portion which slides in the second tube in order to adjust a vertical height of the second dumbbell holder member.

18. The apparatus of claim 17 wherein the first dumbbell holder member includes a further curved portion;

the second dumbbell holder member includes a further curved portion;

wherein the curved portion of the first dumbbell holder member is parallel to and spaced apart from the further curved portion of the first dumbbell holder member;

wherein the curved portion of the second dumbbell holder member is parallel to and spaced apart from the further curved portion of the second dumbbell holder member;

wherein the first dumbbell is configured to be held at one end by the curved portion of the first dumbbell holder member and at an opposing end by the further curved portion of the first dumbbell holder member;

and wherein the second dumbbell is configured to be held at one end by the curved portion of the second dumbbell holder member and at an opposing end by the further curved portion of the second dumbbell holder member.

19. The apparatus of claim 14 wherein the bench apparatus includes a first member, a second member, and a weightlifting bench seat back portion which is attached to the first member;

wherein the first member is rotatably mounted to the second member so that the first member and its attached weightlifting bench seat back portion can be placed in an inclined state, while the second member is substantially parallel to the first, second and third top horizontal members of the cage structure.

20. The apparatus of claim 14 wherein the front support includes a telescoping member and a tube member, and wherein the telescoping member can slide in the tube member to raise or lower a height of the front support.

* * * * *